US007201344B2

(12) United States Patent
Higeta

(10) Patent No.: US 7,201,344 B2
(45) Date of Patent: Apr. 10, 2007

(54) MULTILAYER COIL, WINDING METHOD OF SAME, AND WINDING APPARATUS OF SAME

(75) Inventor: Yuji Higeta, Iino-machi (JP)

(73) Assignee: Nittoku Engineering Kabushiki Kaisha, Saitama (JP)

( * ) Notice: Subject to any disclaimer, the term of this patent is extended or adjusted under 35 U.S.C. 154(b) by 0 days.

(21) Appl. No.: 11/365,825

(22) Filed: Mar. 2, 2006

(65) Prior Publication Data

US 2006/0196984 A1 Sep. 7, 2006

(30) Foreign Application Priority Data

Mar. 3, 2005 (JP) ..... 2005-059134
Aug. 31, 2005 (JP) ..... 2005-251242

(51) Int. Cl.
*B21F 3/04* (2006.01)

(52) U.S. Cl. ..... 242/437; 242/444.4; 29/605

(58) Field of Classification Search ..... 242/437, 242/444.2, 444.4; 29/596, 605
See application file for complete search history.

(56) References Cited

U.S. PATENT DOCUMENTS 1,204,749 A * 11/1916 Wolf ..... 336/206
4,562,975 A * 1/1986 Wackerle et al. ..... 242/437
6,388,188 B1 * 5/2002 Harrison ..... 174/27
2006/0196984 A1 * 9/2006 Higeta ..... 242/176

FOREIGN PATENT DOCUMENTS

JP 08-203720 8/1996

* cited by examiner

*Primary Examiner*—Emmanuel M Marcelo
(74) *Attorney, Agent, or Firm*—Rabin & Berdo, PC

(57) ABSTRACT

In a multilayer coil which winds "n" wire rods (4) ("n" is an integer number of two or more) in line around a winding core (2) having a cross section of a polygonal shape. An intersection portion (5) is formed on a face where feeding of the winding core is made by feeding the wire rods by an amount of "n" wire rods during a period when the wire rods (4) are wound by one round around the winding core (2), so that the wire rods in a lower layer and an upper layer intersect therein. A twist portion (6) is formed at an end of at least one face out of the faces where the feeding is made, wherein two wire rods out of "n" wire rods are twisted to replace an arrangement of the wire rods.

13 Claims, 14 Drawing Sheets

MULTILAYER COIL, WINDING METHOD OF SAME, AND WINDING APPARATUS OF SAME

FIELD OF THE INVENTION

The present invention relates to a multilayer coil and a winding method of the multilayer coil, and a winding apparatus of the multilayer coil.

BACKGROUND OF THE INVENTION

In a case of winding one wire rod in line around a bobbin as a tool for winding, for example, a bobbin a winding core of which has a cross section of a square shape, it is general to perform feeding equal to an amount of a wire diameter of a wire rod on one face of the four faces. In this case the feeding is not made in the other three faces.

When a wire rod is wound to an end of the winding core and then moves on an upper layer for the winding thereon, since on the face where the feeding of the wire rod is made, the winding direction of the wire rod in the lower layer is in reverse to that in the upper layer, a hatched portion, as shown in FIG. 13, is an intersection portion where the wire rod in the lower layer intersects the wire rod in the upper layer. On the face (referred to as a wire rod feeding face) where the wire rod in the lower layer thus intersects the wire rod in the upper layer by feeding the wire rod, the wire rods are overlapped in two layers (for example, refer to Japanese Unexamined Patent Publication No. 8-203720). On a face other than the wire rod feeding face, since a groove between the neighboring wire rods serves as a guiding groove of the wire rod in the upper layer, the wire rods do not intersect and are not overlapped.

Next, a case where a set of two wire rods are wound in parallel to each other in line around a bobbin a wiring core of which has a cross section of a square shape will be explained with reference to FIG. 14A. In this case, on the wire rod feeding face as one face of the four faces, the feeding of the wire rods correspond to an amount of two wire rods (arrow 1 in the figure). At the end of the wire rod feeding face, the wire rods are wound in such a way as to move on the upper layer, leaving a clearance equivalent to an amount of 0.5; wire rods (arrow 2 in the figure) In addition, the wire rods in the upper layer are fed by an amount of two wire rods in the opposing direction to the winding direction of the wire rods in the lower layer (arrow 3 in the figure). In the case of thus winding a set of two wire rods in line, there is generated an intersection portion where the wire rods in the lower layer intersect the wire rods in the upper layer.

At this point, a hatched portion shown in FIG. 14A is a state where the wire rods are wound and overlapped to be in three layers. Accordingly, on the feeding face, the bulge in the direction of the outer diameter increases. Similarly also in a case where a set of three wire rods or a set of four wire rods are wound in parallel to each other in line around a bobbin a winding core of which has a square cross section, a hatched portion on the wire rod feeding face, as shown in FIG. 14B or FIG. 14C, is a state where the wire rods are wound and overlapped to be in three layers.

SUMMARY OF THE INVENTION

In a case of thus winding a set of two wire rods or more in parallel and in line, there exists an intersection portion where the wire rods are wound and overlapped in three layers on a wire rod feeding face, being different from a case where one wire rod is wound in line. This raises a problem that an outer diameter of a coil is forced to be increased.

In view of the above, there exist needs for a multilayer coil, a winding method of the multilayer coil, and a winding apparatus of the multilayer coil which overcome the above-mentioned problems in the related art. The present invention addresses these needs in the related art, as well as other needs, which will become apparent to those skilled in the art from this disclosure.

The present invention has been made from the foregoing problems and has an object of providing a multilayer coil, a winding method of the multiplayer coil, and a winding apparatus of the multilayer coil, which in a case of winding a set of two or more wire rods in parallel and in line around a winding core having a cross section of a polygonal shape, prevents an increase of bulge in an outer direction of the winding core on a wire rod feeding face.

In order to achieve above object, the present invention provides a multilayer coil which winds "n" wire rods ("n" is an integer number of two or more) in line around a winding core having a cross section of a polygonal shape. The multilayer coil comprises an intersection portion which is formed on faces where feeding of the winding core is made and in which the wire rods in a lower layer and an upper layer intersect by feeding the wire rods by an amount of "n" wire rods during a period when the wire rods are wound by one round around the winding core, and a twist portion in which two wire rods out of the "n" wire rods are twisted to replace an arrangement of the wire rods at an end of at least one face out of the faces where the feeding of the winding core is made.

The present invention provides a winding method of a multilayer coil which winds "n" wire rods ("n" is an integer number of two or more) in line around a winding core having a cross section of a polygonal shape. The winding method of a multilayer coil comprises feeding the wire rod by an amount of "n" wire rods during a period when the wire rod is wound by one round around the wire core, and replacing an arrangement of the wire rods by twisting two wire rods out of the "n" wire rods at an end of at least one face out of the faces where the feeding of the winding core is made.

The present invention provides a winding apparatus of a multilayer coil. The winding apparatus of a multilayer coil comprises a spindle shaft rotating around an axis together with a winding core on which wire rods are wound, a plurality of nozzles leading the wire rods to the winding core, wire rod feeding mechanism which travels the nozzles in an axial direction of the winding core, and wire rod twist mechanism which twists the wire rods by replacing locations of the nozzles.

DETAILED DESCRIPTION OF THE PREFERRED EMBODIMENTS

Preferred embodiments of the present invention will be explained with reference to the drawings. It will be apparent to those skilled in the art from this disclosure that the following description of the preferred embodiments of the present invention is provided for illustration only, and not for the purpose of limiting the present invention as defined by the appended claims and their equivalents.

First Preferred Embodiment

Figure 1A:
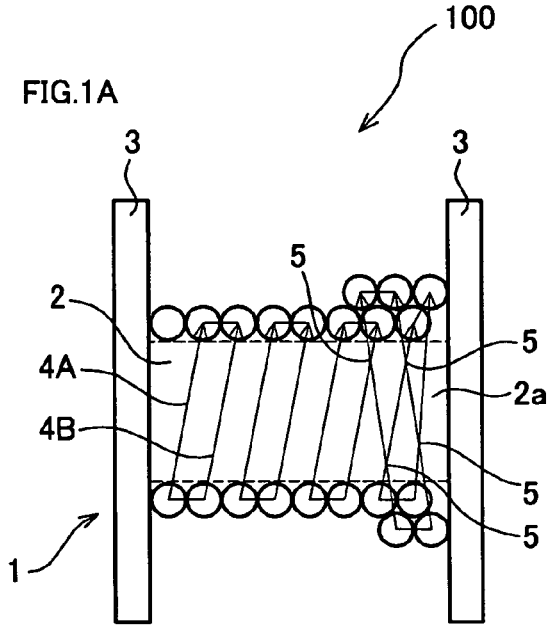
FIGS. 1A–1D are views, each showing a multilayer coil in a first preferred embodiment according to the present invention.
Figure 1C:
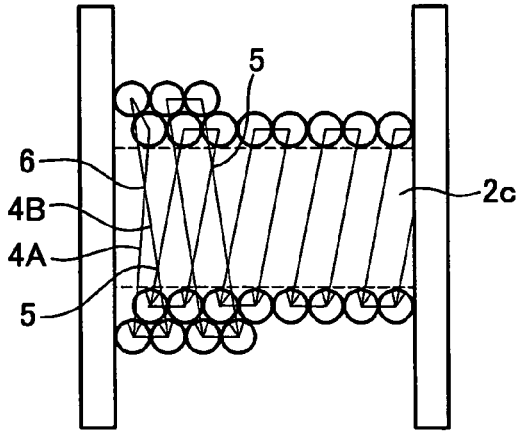
Figure 1B:
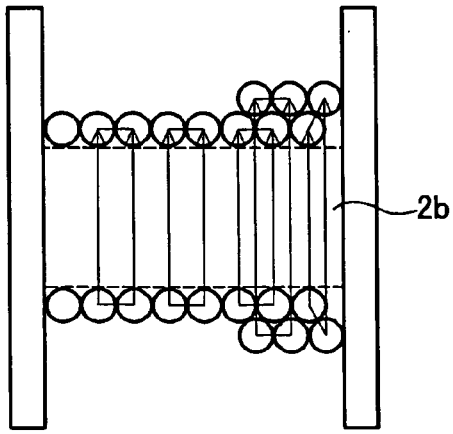
Figure 1D:
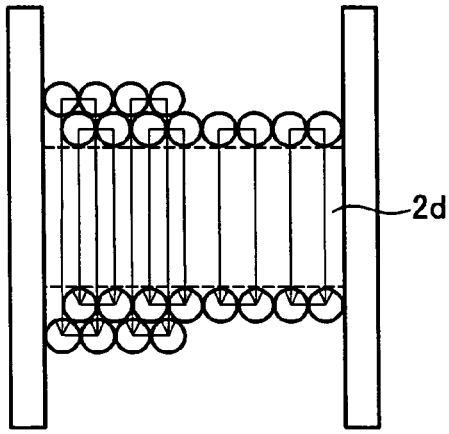

A multilayer coil 100 in a first preferred embodiment of the present invention will be explained with reference to FIGS. 1A–1D and FIGS. 2A–2I. FIGS. 1A–1D are views, each showing the multilayer coil 100 of which wire rods are wound around a winding core: FIG. 1A is a front view; FIG. 1B is a plan view; FIG. 1C is a rear view; and FIG. 1D is a bottom view. FIGS. 2A–2I are views, each showing a winding method at an end of a winding core of the multilayer coil 100. An arrow in the figures shows a winding direction. In FIGS. 2A–2I, only wire rods related to the explanation are illustrated and the other wire rods are not illustrated.

The multilayer coil 100 is constructed by winding wire rods around a bobbin 1 in multiple layers. The bobbin 1 is formed of a winding core 2 around which wire rods are wound and collars 3 disposed in both sides of the winding core 2, co-axial therewith. A cross section of the winding core is a square shape and a set of two wire rods 4A and 4B are wound in parallel and in line around the winding core 2, each of the two wire rods having nearly the same wire diameter. Wire rod feeding faces are two faces composed of a front face 2*a* and a back face 2*c* as two opposing faces, and an amount of the feeding is set as a wire diameter of one wire rod on each face. The feeding is not made on a plan face 2*b* and a bottom face 2*d* as two other faces. Hereby, in a case of winding wire rods in multiple layers around the winding core 2, the winding direction of the wire rods in the lower layer is opposite to the winding direction of the wire rods in the upper layer on the front face 2*a* and the back face 2*c*. In this way, the multilayer coil 100 includes an intersection portion 5 where the wire rods in the lower layer intersect the wire rods in the upper layer on each of the front face 2*a* and the back face 2*c*.

The multilayer coil 100 includes a twist portion 6 at an end of the back face 2*c*. In the twist portion 6, two wire rods as the wire rod 4A moving on from the lower layer to the upper layer and the wire rod 4B having the winding direction of the wire rod opposite to that of the wire rod in the lower layer are twisted and an arrangement of the wire rods is replaced. Since the twist portion 6 is caused by two wire rods 4A and 4B being twisted and intersected, the wire rods are overlapped in two layers. After the wire rods 4A and 4B form the twist portion 6 at the end of the back face 2*c*, one wire rod 4A moves on between the collar 3 and the wire rod in the lower layer, and the other wire rod 4B intersects the wire rod in the lower layer to be wound in a groove between the wire rods in the lower layer. In the twist portion 6 and the intersection portion 5 at the end of the back face 2*c*, the wire rods are thus wound in two layers, not in three layers. Note that even at the end of the front face 2*a*, in the intersection portion 5, the wire rods are wound in two layers, not in three layers.

Figure 2A:
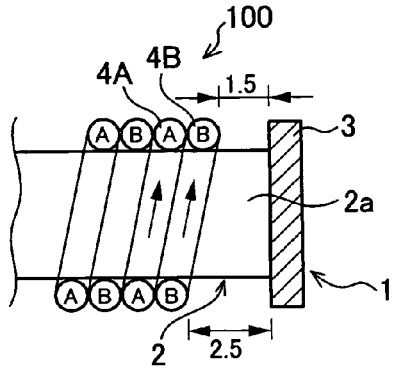
FIGS. 2A–2I are views, each showing a winding method at a winding core end of the multilayer coil.
Figure 2B:
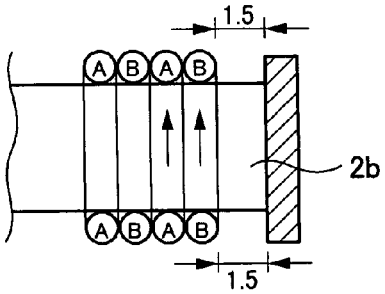
Figure 2C:
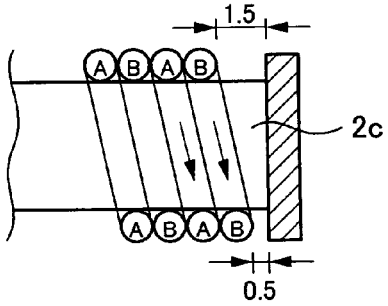
Figure 2D:
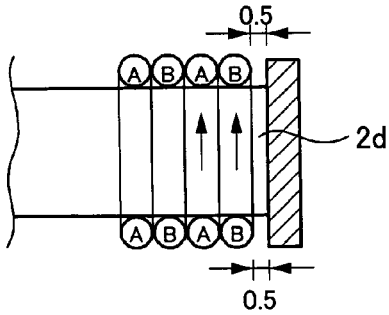
Figure 2E:
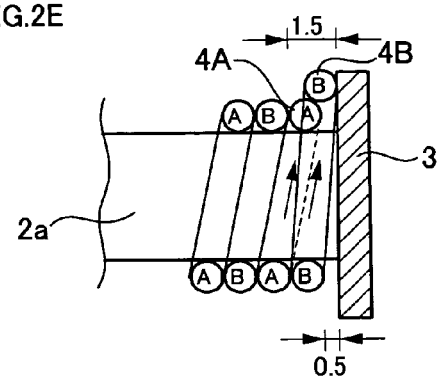
Figure 2F:
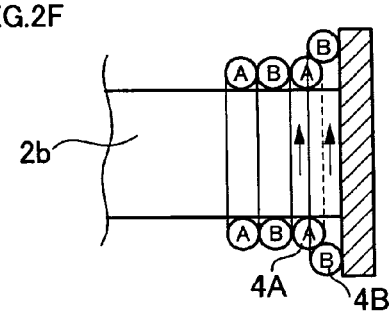
Figure 2G:
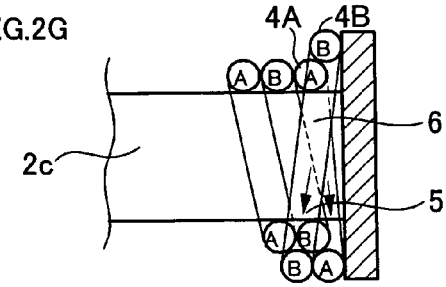
Figure 2H:
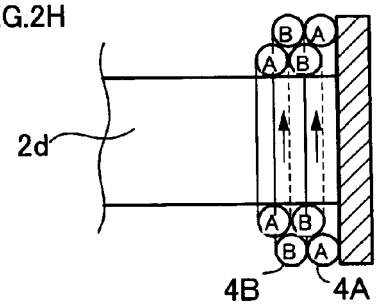
Figure 2I:
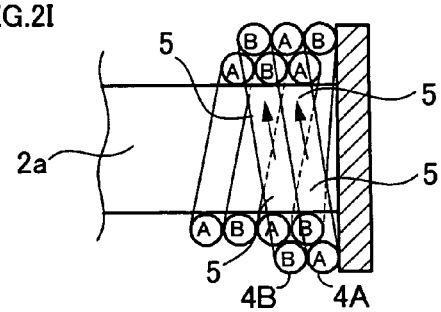

Next, a winding method of the multilayer coil 100 will be explained with reference to FIGS. 2A–2I. FIGS. 2A, 2E and 2I are front views, FIGS. 2B and 2F are plan views, FIGS. 2C and 2G are rear views and FIGS. 2D and 2H are bottom views. Note that for explanatory convenience, the rear views as FIGS. 2C and 2G show a state where the bobbin 1 is seen transparently from the front side.

(1) Two wire rods 4A and 4B begin to be wound in parallel from the same face of the winding core 2 having a cross section of a square shape.

(2) As shown in FIGS. 2A–2D, the feeding equal in amount to one wire rod is produced on the front face 2*a* and the back face 2*c*, not on the plan face 2*b* and the bottom face 2*d*.

(3) At the end of the front face 2*a*, as shown in FIG. 2E, the wire rods 4A in an inner side on the winding core 2 are fed by an amount of one wire rod toward the clearance of 1.5 wire rods on the winding core 2 from the collar 3 to be wound around the winding core 2, and also the wire rod 4B in an outer side thereon moves on a clearance formed between the wire rod 4A and the collar 3, the clearance having a width corresponding to an amount of 0.5 wire rods, to be wound in an upper layer.

(4) On the next flat face 2*b*, as shown in FIG. 2F, the wire rods 4A and 4B are wound at the end of the winding core 2 without the feeding thereof.

(5) On the next back face 2*c*, as shown in FIG. 2G, the wire rods 4A and 4B are twisted and wound to replace an arrangement of the wire rods 4A and 4B. In more detail, the wire rod 4A in an inner side on the winding core 2 moves on a clearance formed between the wire rod in the lower layer and the collar 3, the clearance having a width corresponding to an amount of 0.5 wire rods, to be wound in an upper layer. In addition, the wire rod 4B in an outer side on the winding core 2 is wound in the opposite direction to the winding direction of the wire rod in the lower layer and intersects the wire rod 4A thereon. Thereby, the wire rod 4B forms a twist portion 6 and also intersects the wire rod in the lower layer to be wound in a groove between neighboring wire rods wound in the lower layer. In this way, there are produced at the end of the back face 2*c* the twist portion 6 generated by twisting the wire rods 4A and 4B and the intersection portion 5 generated by intersection of the wire rod 4B and the wire rod in the lower layer. In both of the twist portion 6 and the intersection portion 5, the wire rods are wound and overlapped in two layers, not in three layers. Note that replacement of the arrangement of the wire rods 4A and 4B indicates that, the wire rods in the lower layer are arranged in the order of the wire rods 4A, 4B, 4A, 4B . . . from left to right in FIG. 2G and, as opposed to the above, in the upper layer the wire rods are arranged in the order of the wire rods 4B, 4A, 4B, 4A . . . from left to right in FIG. 2G.

(6) On the next bottom face 2*d*, as shown in FIG. 2H, the wire rods 4A and 4B are guided and wound in a groove between the neighboring wire rods in the lower layer without the feeding.

(7) On the next front face 2*a*, as shown in FIG. 2I, the wire rods 4A and 4B are fed in the direction opposite to the feeding direction of the wire rods in the lower layer and are wound. In this way, the wire rods in the lower layer intersect the wire rods in the upper layer on the front face 2*a*. However, in the intersection portion 5, the wire rods are wound and overlapped in two layers, not in three layers.

In the multilayer coil 100 as described above, the wire rod feeding faces are formed of the front face 2*a* and the back face 2*c*, but the wire rod feeding faces may be set as any two faces of the winding core 2. The cross section of the winding core 2 is a square shape, but may be a polygonal shape other than it.

Figure 3A:
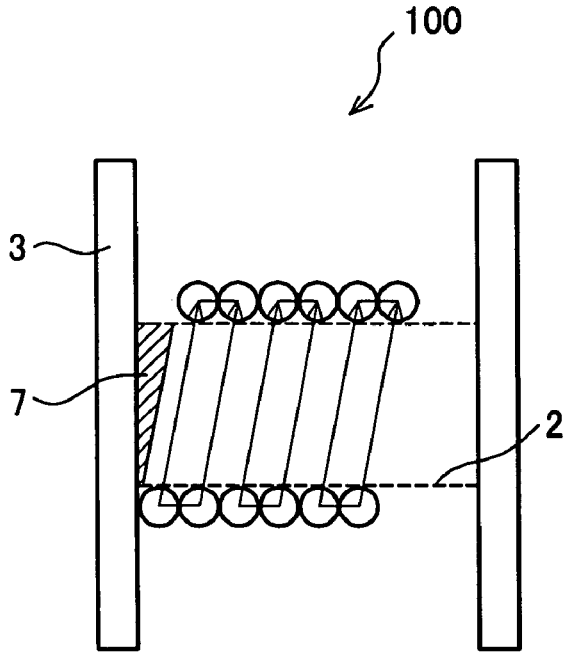
FIGS. 3A and 3B are front views, each showing the multilayer coil.
Figure 3B:
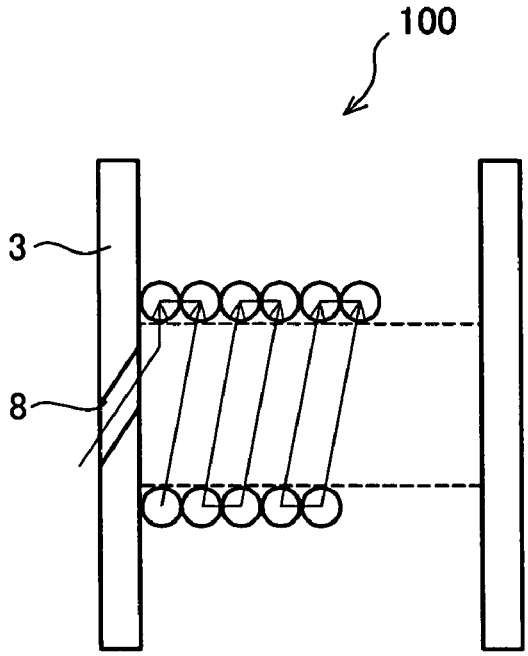

At start of the winding, on the wire rod feeding face, a projection 7 in size corresponding to the feeding amount (an amount of one wire rod in the multilayer coil 100) of the wire rod needs to be disposed at the end of the winding core 2, as shown in FIG. 3A, in such a way as to prevent movement of wound wire rods. In addition, instead of disposing the projection, as shown in FIG. 3B, an oblique notch 8 may be disposed in the collar 3 to hold the wire rod with the notch 8.

As described above, in the multilayer coil 100 the feeding is made on any two faces by an amount of one wire rod and also at the end of the winding core 2, two wire rods as the wire rod 4A moving on from the lower layer to the upper layer and the wire rod 4B the winding direction of which is opposite to that of the wire rod in the lower layer are twisted to replace the arrangement of the wire rods. This prevents the wire rod from bulging in the outer direction on the wire rod feeding face, thus providing a compact multilayer coil.

Second Preferred Embodiment

Figure 4A:
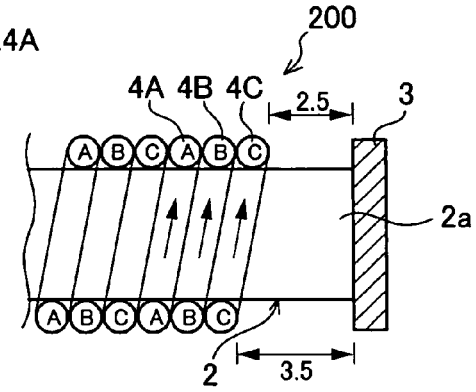
FIGS. 4A–4I are views, each showing a winding method at a winding core end of a multilayer coil in a second preferred embodiment of the present invention.
Figure 4B:
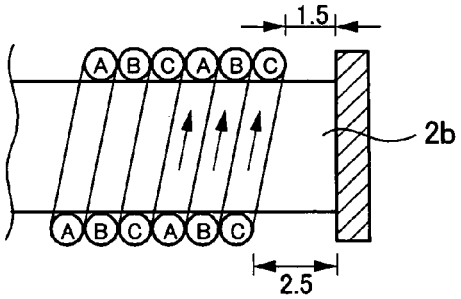
Figure 4C:
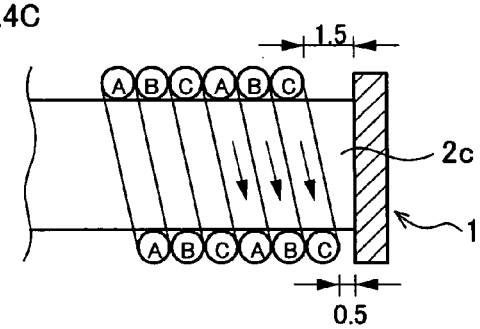
Figure 4D:
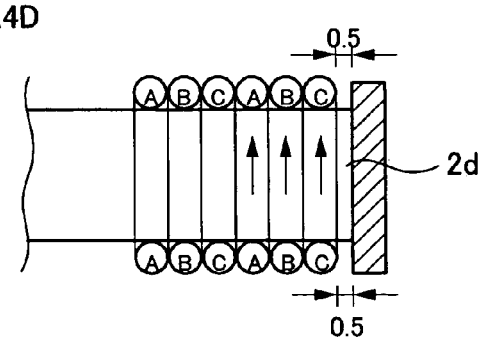
Figure 4E:
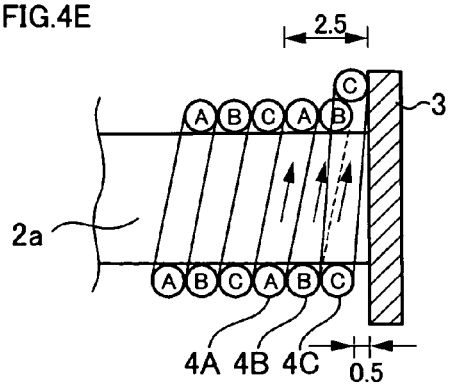
Figure 4F:
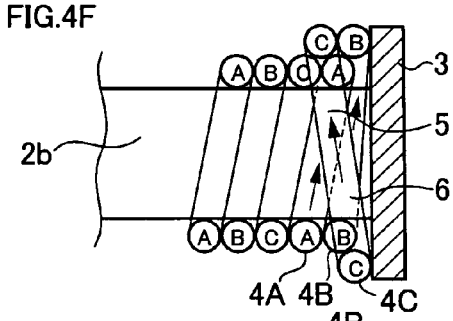
Figure 4G:
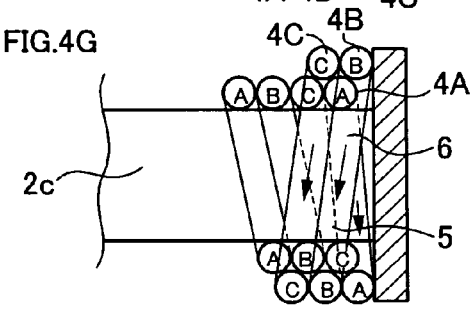
Figure 4H:
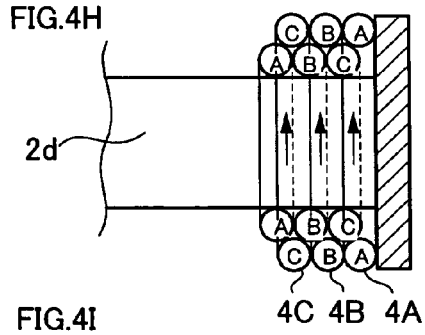
Figure 4I:
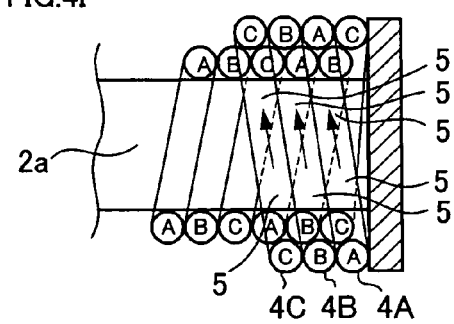

Next, a multilayer coil 200 in a second preferred embodiment of the present invention will be explained with reference to FIGS. 4A–4I, which show a winding method at an end of a winding core in the multilayer coil 200. FIGS. 4A, 4E and 4I are front views, FIGS. 4B and 4F are plan views, FIGS. 4C and 4G are rear views and FIGS. 4D and 4H are bottom views. Note that for explanatory convenience, the rear views as FIGS. 4C and 4G show a state where the bobbin 1 is seen transparently from the front side. In addition, only wire rods related to the explanation are illustrated and the other wire rods are not illustrated.

The multilayer coil 200 differs from the multilayer 100 in a point that the number of wire rods wound around the winding core 2 is three (4A, 4B and 4C). Wire rod feeding faces are three faces composed of a front face 2*a*, a plan face 2*b* and a back face 2*c* and an amount of the feeding is set as a wire diameter of one wire rod on each face. The feeding is not made on a bottom face 2*d* as another face. Hereby, in a case of winding wire rods in multiple layers around the winding core 2, the winding direction of the wire rods in the lower layer is opposite to the winding direction of the wire rods in the upper layer on the front face 2*a*, the plan face 2*b* and the back face 2*c*. In this way, the multilayer 200 includes an intersection portion 5 where the wire rod in the lower layer intersects the wire rod in the upper layer on each of the front face 2*a*, the plan face 2*b* and the back face 2*c*.

The multilayer coil 200 includes a twist portion 6 at each end of the plan face 2*b* and the back face 2*c*. The twist portion 6 includes two wire rods as the wire rod moving on from the lower layer to the upper layer and the wire rod having the winding direction of the wire rod opposite to that of the wire rod in the lower layer are twisted to replace an arrangement of the wire rods.

Next, a winding method of a multilayer coil 200 will be explained.

(1) Three wire rods 4A, 4B and 4C begin to be wound in parallel from the same face of the winding core 2 having a cross section of a square shape.

(2) As shown in FIGS. 4A–4D, the feeding equal in amount to one wire rod is produced on the front face 2*a*, the plan face 2*b* and the back face 2*c*, not on the bottom face 2*d*.

(3) At the end of the front face 2*a*, as shown in FIG. 4E, the wire rods 4A and 4B in an inner side on the winding core 2 are fed by an amount of one wire rod toward the clearance of 2.5 wire rods on the winding core 2 from the collar 3 to be wound around the winding core 2, and also the wire rod 4C in an outer side thereon moves on a clearance formed between the wire rod 4B and the collar 3, the clearance having a width corresponding to an amount of 0.5 wire rods, to be wound in an upper layer.

(4) On the next flat face 2*b*, as shown in FIG. 4F, the wire rods 4A is wound by the feeding equal in amount to one wire rod, the wire rods 4A and 4C are twisted and wound to replace an arrangement of the wire rods 4A and 4C. In more detail, the wire rod 4B in an inner side on the winding core 2 moves on a clearance formed between the wire rod in the lower layer and the collar 3, the clearance having a width corresponding to an amount of 0.5 wire rods, to be wound in an upper layer. In addition, the wire rod 4C in an outer side on the winding core 2 is wound in the opposite direction to the winding direction of the wire rod in the lower layer and intersects the wire rod 4B thereon. Thereby, the wire rod 4B forms a twist portion 6 and also intersects the wire rod 4A in the lower layer to be wound in a groove between neighboring wire rods wound in the lower layer. In this way, there are produced at the end of the plan face 2*b* the twist portion 6 generated by twisting the wire rods 4B and 4C and the intersection portion 5 generated by intersection of the wire rod 4C and the wire rod 4A in the lower layer. In both of the twist portion 6 and the intersection portion 5, the wire rods are wound and overlapped in two layers, not in three layers.

(5) On the next back face 2*c*, as shown in FIG. 4G, the wire rods 4C is wound with the feeding equal in amount to one wire rod, and the wire rods 4A and 4B are twisted and wound to replace an arrangement of the wire rods 4A and 4B. In more detail, the wire rod 4A in an inner side on the winding core 2 moves on a clearance formed between the wire rod in the lower layer and the collar 3, the clearance having a width corresponding to an amount of 0.5 wire rods, to be wound in an upper layer. In addition, the wire rod 4B in an outer side on the winding core 2 is wound in the opposite direction to the winding direction of the wire rod in the lower layer and intersects with, and on the wire rod 4A. Thereby, the wire rod 4B forms a twist portion 6 and also intersects the wire rod in the lower layer to be wound between the wire rods 4A and 4C. This causes replacement of an arrangement of the wire rods in the layer and the wire rods in the upper layer. In this way, there are produced at the end of the back face 2*c* the twist portion 6 generated by twisting the wire rods 4A and 4B and the intersection portion 5 generated by intersection of the wire rod 4B and the wire rod in the lower layer. In both of the twist portion 6 and the intersection portion 5, the wire rods are wound and overlapped in two layers, not in three layers.

(6) On the next bottom face 2*d*, as shown in FIG. 4H, the wire rods 4A, 4B and 4C are guided and wound in a groove between the neighboring wire rods in the lower layer without the feeding.

(7) On the next front face 2*a*, as shown in FIG. 4I, the wire rods 4A, 4B and 4C are fed in the direction opposite to the feeding direction of wire rods in the lower layer and are wound. In this way, the wire rods in the lower layer intersect the wire rods in the upper layer on the front face 2*a*. However, in any of the intersection portions 5, the wire rods are wound and overlapped in two layers, not in three layers.

In the multilayer coil 200 as described above, the wire rod feeding faces are formed of the front face 2*a*, the plan face 2*b* and the back face 2*c*, but the wire rod feeding faces may be set as any three faces of the winding core 2. The cross section of the winding core 2 is a square shape, but may be a triangle shape or a polygonal shape more than it.

At start of the winding, on the wire rod feeding face, a projection 7 in size corresponding to the feeding amount of the wire rod needs to be disposed at the end of the winding core 2 in the same way with the multilayer coil 100, in such a way as to prevent movement of wire rods to be wound. In addition, instead of disposing the projection, an oblique notch 8 may be disposed in the collar 3.

As described above, in the multilayer coil 200 the feeding is made in any three faces by an amount of one wire rod and also at the end of each of two faces out of three faces in the winding core 2 where the feeding is made, two wire rods as the wire rod moving on from the lower layer to the upper layer and the wire rod the winding direction of which is opposite to that of the wire rod in the lower layer are twisted to replace the arrangement of the wire rods. Thereby, in the multilayer coil 200 the wire rod is prevented from bulging in the outer direction on the wire rod feeding face, thus providing a compact multilayer coil.

Third Preferred Embodiment

Figure 5A:
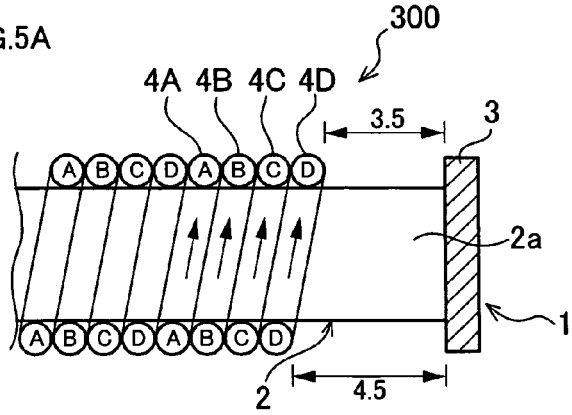
FIGS. 5A–5I are views, each showing a winding method at a winding core end of a multilayer coil in a third preferred embodiment of the present invention.
Figure 5B:
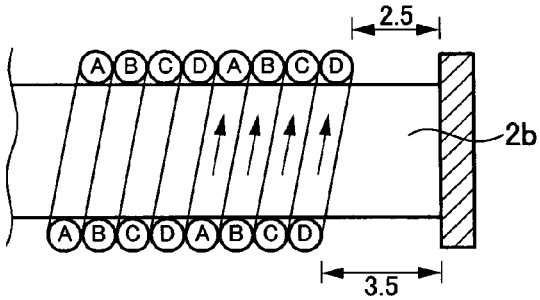
Figure 5C:
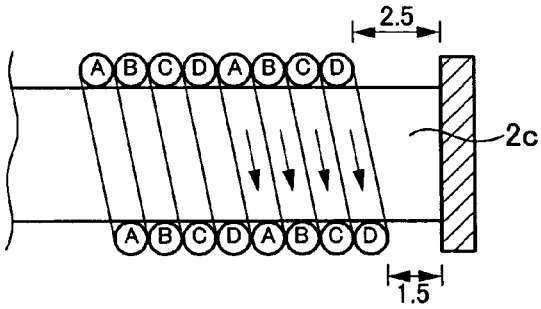
Figure 5D:
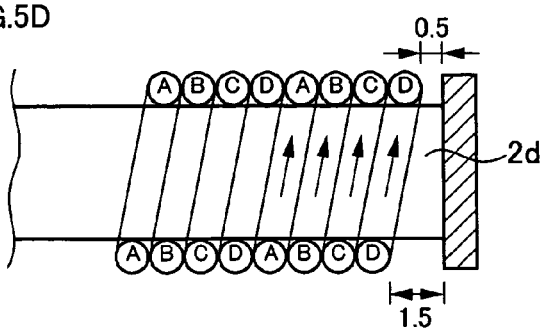
Figure 5E:
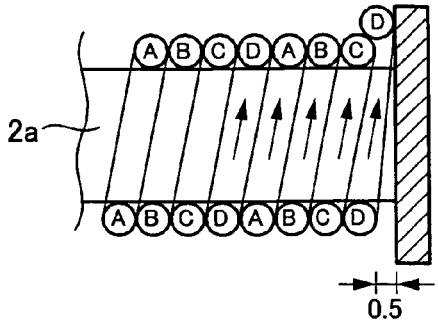
Figure 5F:
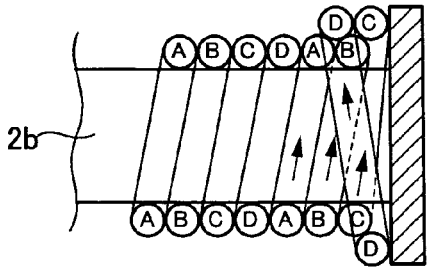
Figure 5G:
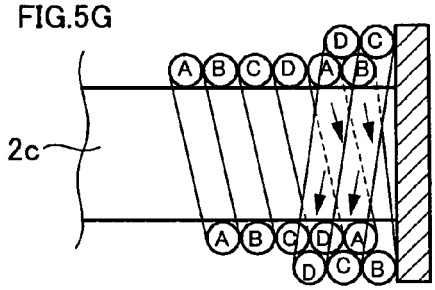
Figure 5H:
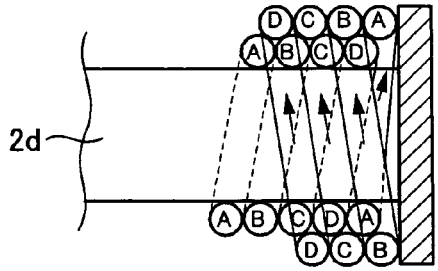
Figure 5I:
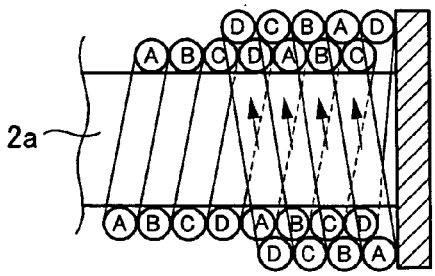

Next, a multilayer coil 300 in a third preferred embodiment of the present invention will be explained with reference to FIGS. 5A–5I, which show a winding method at an end of a winding core in the multilayer coil 300. FIGS. 5A, 5E and 5I are front views, FIGS. 5B and 5F are plan views, FIGS. 5C and 5G are rear views and FIGS. 5D and 5H are bottom views. Note that for explanatory convenience, the rear views as FIGS. 5C and 5G show a state where the bobbin 1 is seen transparently from the front side. In addition, only wire rods related to the explanation are illustrated and the other wire rods are not illustrated.

The multilayer coil 300 differs from the multilayer coils 100 and 200 in a point that the number of wire rods wound around the winding core 2 is four (4A, 4B, 4C and 4D). Wire rod feeding faces are all faces (composed of a front face 2*a*, a plan face 2*b*, a back face 2*c* and a bottom face 2*d*) and an amount of the feeding is set as an amount of one wire rod on each face. Hereby, in a case of winding wire rods in multiple layers around the winding core 2, the winding direction of the wire rods in the lower layer is opposite to the winding direction of the wire rods in the upper layer on all the faces. In this way, the multilayer 300 includes an intersection portion 5 where the wire rod in the lower layer intersects the wire rod in the upper layer on all the faces.

The multilayer coil 300 includes a twist portion 6 at each end of the plan face 2*b*, the back face 2*c* and the bottom face d. In the twist portion 6, two wire rods as the wire rod moving on from the lower layer to the upper layer and the wire rod having the winding direction of the wire rod opposite to that of the wire rod in the lower layer are twisted and an arrangement of the wire rods is replaced.

A winding method of the multilayer coil 300 is the same as that in the multilayer coils 100 and 200 and therefore, the explanation thereof is omitted.

In the first—to third preferred embodiments as described above, a case where the number of wire rods is from two to four is explained, but the present invention is not limited thereto and can be applied to a case where the number of wire rods is five or more when a cross section of the winding core is 5 or more angle shape.

Therefore, consider a case where the number of wire rods is set as "n" pieces ("n" is the integer number of 2 or more) and the "n" pieces of wire rods are wound in line around a winding core having a cross section of a "N" or more angle shape ($N \geqq n$). In this case, on any "n" faces out of the "N" faces, the wire rods is wound by the feeding equal in amount to one wire rod. At the end of each of "n"−1 faces out of "n" faces, two wire rods as the wire rod moving on from the lower layer to the upper layer and the wire rod the winding direction of which is opposite to that of the wire rod in the lower layer are twisted to replace the arrangement of the wire rods. By thus winding the "n" wire rods, the wire rod is prevented from bulging in the outer direction on the "n" wire rod feeding faces, thereby providing a compact multilayer coil.

Fourth Preferred Embodiment

Figure 6:
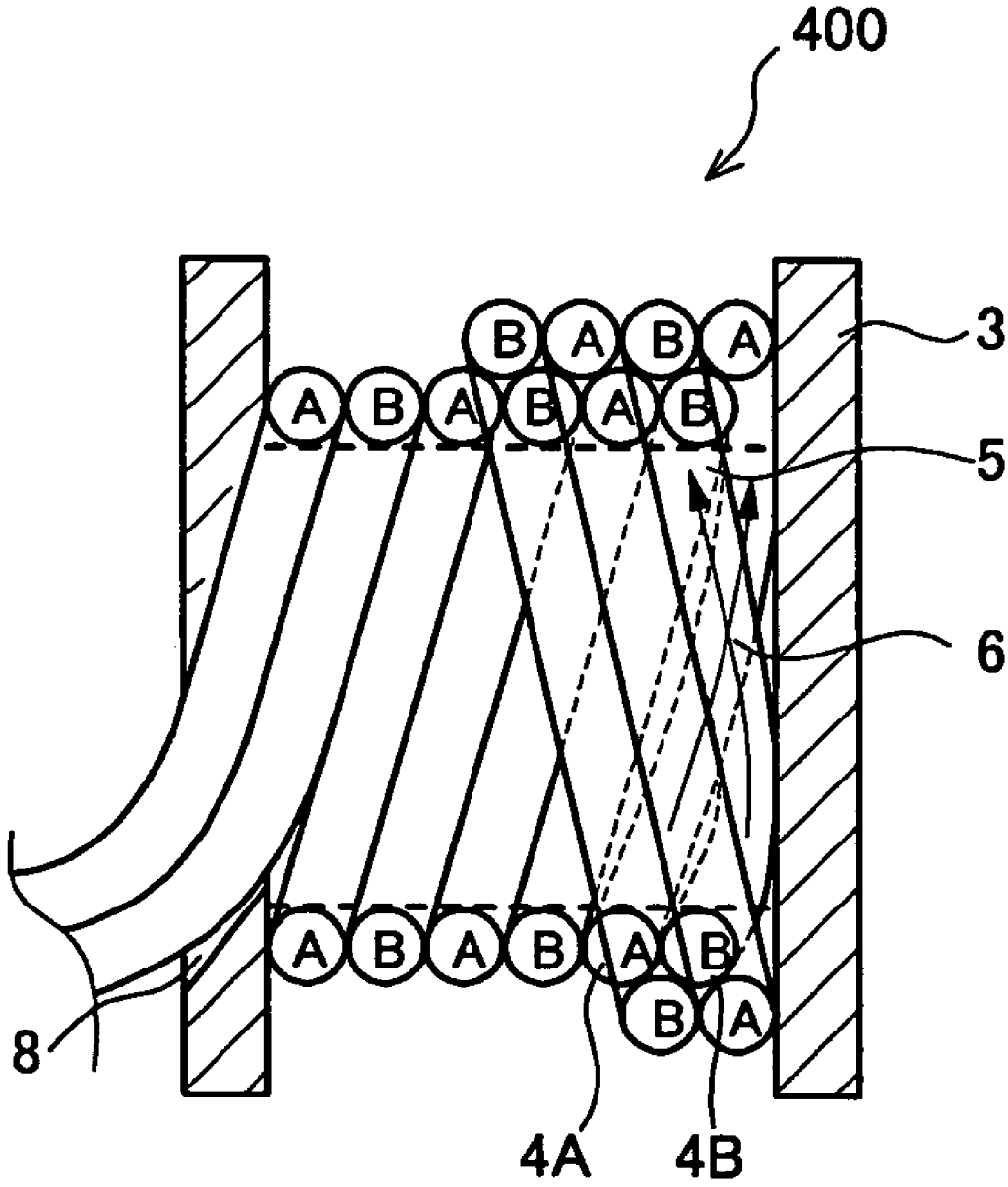
FIG. 6 is a front view showing a multilayer coil in a fourth preferred embodiment according to the present invention.

Next, a multilayer coil 400 in a fourth preferred embodiment of the present invention will be explained with reference to FIG. 6 and FIGS. 7A–7F. FIG. 6 is a front view of the multilayer coil 400 showing a state where wire rods are wound around a winding core. FIGS. 7A–7F are views, each showing a winding method at an end of the winding core of the multilayer coil 400. An arrow in the figures shows a winding direction. In FIGS. 7A–7F, only wire rods related to the explanation are illustrated and the other wire rods are not illustrated.

In the multilayer coil 400, a cross section of the winding core is a square shape and two wire rods 4A and 4B are wound in parallel and in line around the winding core 2, the two wire rods each having nearly the same wire diameter. The construction of a bobbin 1 is the same as that in the multilayer coil 100 and an oblique notch 8 for holding the wire rod at start of the winding is disposed in a collar 3.

The wire rod feeding face is one face composed of a front face 2*a* and an amount of the feeding is set as two wire rods on the front face 2*a*. The feeding is not made on the other three faces. Hereby, in a case of winding wire rods in multiple layers around the winding core 2, the winding direction of the wire rods in the lower layer is opposite to the winding direction of the wire rods in the upper layer on the front face 2*a*. In this way, the front face 2*a* of the multilayer 400 includes an intersection portion 5 thereon where the wire rod in the lower layer and the wire rod in the upper layer intersect.

The multilayer coil 400 includes a twist portion 6 at an end of the front face 2*a*. In the twist portion 6, two wire rods 4A and 4B moving on from the lower layer to the upper layer are twisted and an arrangement of the wire rods is replaced. The twist portion 6 is caused by twisting two wire rods 4A and 4B, therefore leading to formation of two layers of the wire rods. Since the twist portion 6 is generated closer to the end of the winding core 2, it does not interfere with the neighboring wire rod. After the wire rods 4A and 4B which have moved on the upper layer are wound by ¾ rounds around the end of the winding core 2 without the feeding, they are wound on the front face 2*a* by feeding them in the direction opposite to that of the wire rod in the lower layer. At this point, since the twist portion 6 is positioned closer to the end of the winding core 2, the wire rods 4A and 4B do not interfere with the twist portion 6. The wire rods in the lower and upper layers are not wound or overlapped in three layers.

Figure 7A:
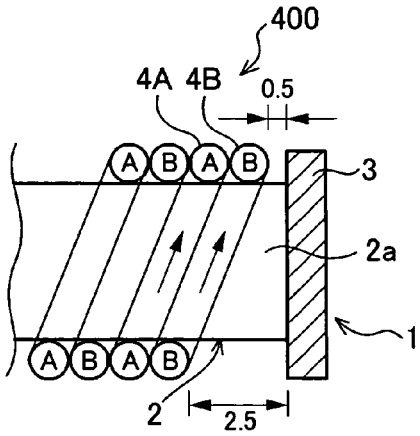
FIGS. 7A–7F are views, each showing a winding method at a winding core end of the multilayer coil in the fourth preferred embodiment.
Figure 7B:
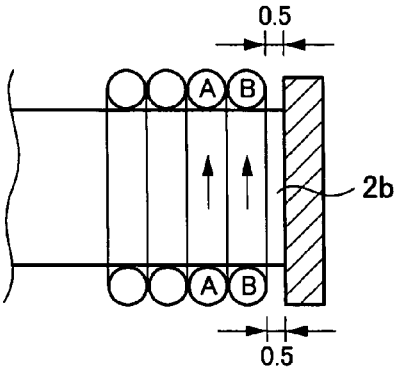
Figure 7C:
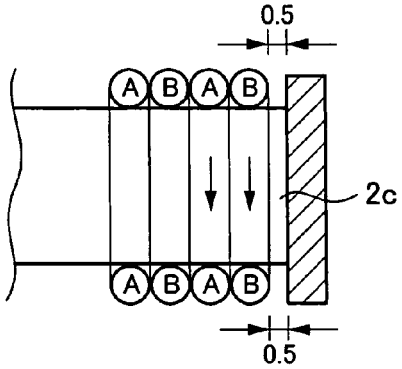
Figure 7D:
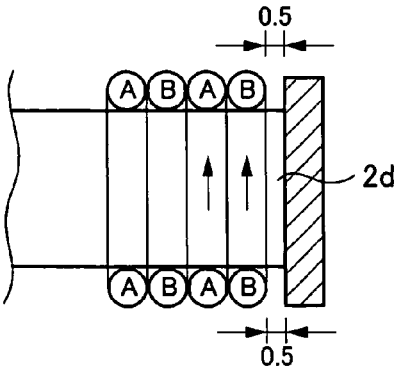
Figure 7E:
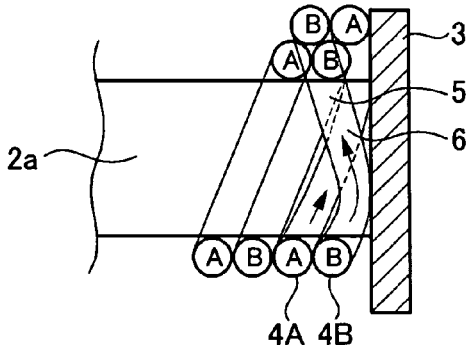
Figure 7F:
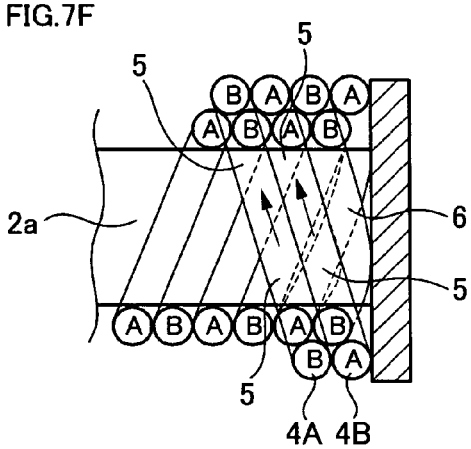

Next, a winding method of the multilayer coil 400 will be explained with reference to FIGS. 7A–7F. FIGS. 7A, 7E and 7F are front views, FIG. 7B is a plan view, FIG. 7C is a rear view and FIG. 7D is a bottom view. It should be noted that for explanatory convenience, the rear views as FIG. 7C shows a state where the bobbin 1 is seen transparently from the front side.

(1) Two wire rods 4A and 4B begin to be wound in parallel from the same face of the winding core 2 having a cross section of a square shape.

(2) As shown in FIGS. 7A–7D, the feeding equal in amount to two wire rods is produced on the front face 2*a*, and not on plan face 2*b*, the back face 2*c* and the bottom face 2*d*. At the end of the winding core 2, the wire rods are wound so as to leave a clearance having a width equal in amount to 0.5 wire rods.

(3) At the end of the front face 2*a*, as shown in FIG. 7E, the wire rods 4A and 4B moving on from the lower layer to the upper layer are twisted and the arrangement thereof is replaced. In more detail, the wire rod 4A in an inner side on the winding core 2 moves on a clearance formed between the wire rod in the lower layer and the collar 3, the clearance having a width equal in amount to 0.5 wire rods, to be wound in an upper layer. In addition, the wire rod 4B in an outer side on the winding core 2 is wound in the opposite direction to the winding direction of the wire rod in the lower layer and intersects the wire rod 4A thereon. Thereby, the wire rod 4B forms a twist portion 6 and also intersects the wire rod in the lower layer to be moved and wound on a groove between neighboring wire rods wound in the lower layer. In this way, there are produced at the end of the front face 2*a* the twist portion 6 generated by twisting the wire rods 4A and 4B and the intersection portion 5 generated by intersection of the wire rod 4B and the wire rod in the lower layer. In both of the twist portion 6 and the intersection portion 5, the wire rods are wound and overlapped in two layers, not in three layers.

(4) On the next plan face 2*b*, the back face 2*c* and the bottom face 2*d*, the wire rods 4A and 4B are guided and wound on the clearance between the wire rod in the lower layer and the collar 3, the clearance having a width equal in amount to 0.5 wire rod, and the groove formed between the neighboring wire rods in the lower layer without the feeding thereof. The illustration is omitted (5) On the, next front face 2*a*, as shown in FIG. 7F, the wire rods 4A and 4B are wound by feeding them in the direction opposite to that of the winding rod in the lower layer. At this point, since the twist portion 6 is positioned closer to the end of the winding core 2, the wire rods 4A and 4B do not interfere with the twist portion 6 and intersect only the wire rods in the lower layer to be wound. Accordingly, in each of the intersections of the lower and upper layers the wire rods are wound and overlapped in two layers, not wound or overlapped in three layers.

In the multilayer coil 400 as described above, the wire rod feeding face is formed of the front face 2*a*, but the wire rod feeding faces may be set as any one face of the winding core 2. The cross section of the winding core 2 is a square shape, but may be a polygonal shape other than it.

As described above, in the multilayer coil 400 the feeding is made in any one face by an amount of two wire rods and also at the end of the face where the feeding is made, two wire rods moving on from the lower layer to the upper layer are twisted to replace the arrangement of the wire rods. Hereby, the multilayer coil 400 prevents the wire rod from bulging in the outer direction on the wire rod feeding face, thus providing a compact multilayer coil.

Fifth Preferred Embodiment

Figure 8A:
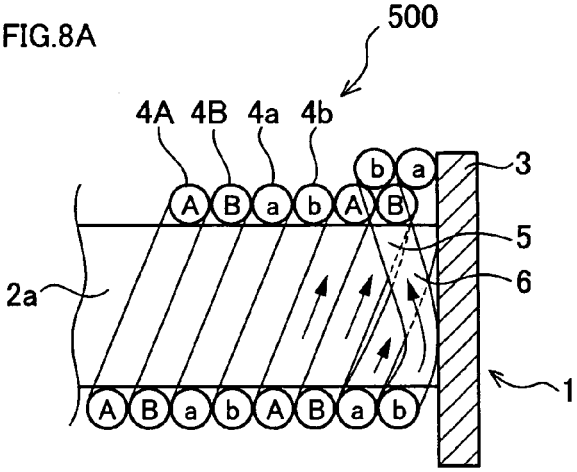
FIGS. 8A–8E are views, each showing a winding method at a winding core end of a multilayer coil in a fifth preferred embodiment of the present invention.
Figure 8D:
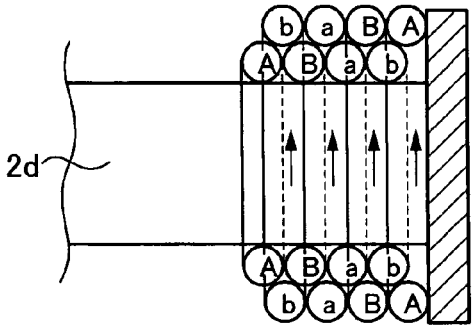
Figure 8B:
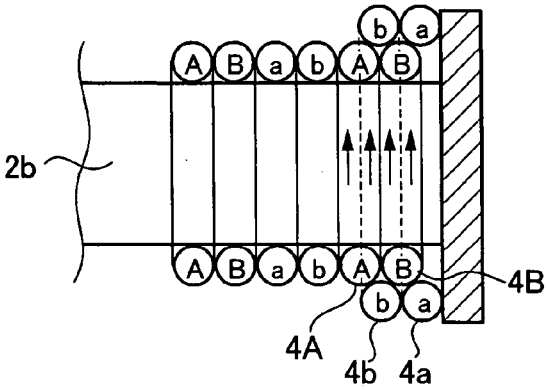
Figure 8E:
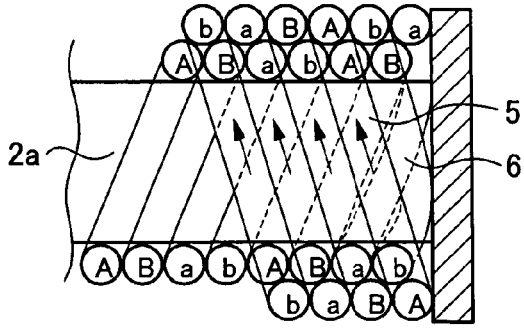
Figure 8C:
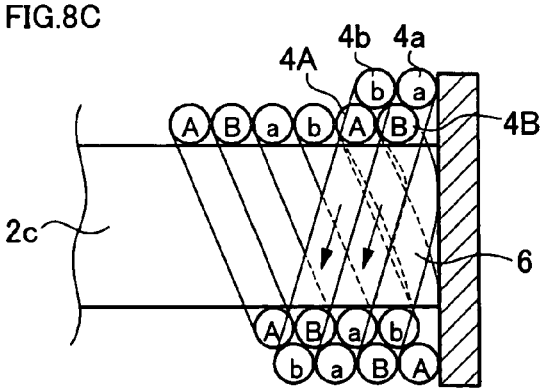

Next, a multilayer coil 500 in a fifth preferred embodiment of the present invention will be explained with reference to FIGS. 8A–8E. FIGS. 8A–8E show a winding method at an end of a winding core in the multilayer coil 500. FIGS. 8A and 8E are front views, FIG. 8B is a plan view, FIG. 8C is a rear view and FIG. 8D is a bottom view. It should be noted that for explanatory convenience, the rear view 8C shows a state where the bobbin 1 is seen transparently from the front side. In addition, only wire rods related to the explanation are illustrated and the other wire rods are not illustrated.

The multilayer coil 500 differs from the multilayer coil 400 in a point that the total number of wire rods wound around the winding core 2 is four made of two sets of two wire rods (4A, 4B, 4*a* and 4*b*). Wire rod feeding faces are two opposing faces composed of a front face 2*a* and a back face 2*c* and on each face, the feeding is set as an amount equal to two wire rods. The feeding is not made on the other two faces as the plan face 2*b* and the bottom face 2*d*. Hereby, in a case of winding wire rods in multiple layers around the winding core 2, the winding direction of the wire rods in the lower layer is opposite to the winding direction of the wire rods in the upper layer on the front face 2*a* and the back face 2*c*. In this way, the multilayer 500 includes an intersection portion 5 on each of the front face 2*a* and the back face 2*c* where the wire rods in the lower layer and the wire rods in the upper layer intersect.

The multilayer coil 500 includes a twist portion 6 on each end of the front face 2*a* and the back face 2*c*. In the twist portion 6, two wire rods moving on from the lower layer to the upper layer are twisted and an arrangement of the wire rods is replaced.

Next, a winding method of the multilayer coil 500 will be explained with reference to FIGS. 8A–8E.

(1) Two sets of two wire rods 4A, 4B, 4*a* and 4*b* begin to be wound in parallel from the same face of the winding core 2 having a cross section of a square shape.

(2) As shown in FIGS. 8A–8E, the feeding equal in amount to two wire rods is produced on the front face 2*a* and the back face 2*c*, and not on the plan face 2*b* or the bottom face 2*d*. At the end of the winding core 2, the wire rods are wound so as to leave a clearance having a width equal in amount to 0.5 wire rods.

(3) At the end of the front face 2*a* as the wire rod feeding face, as shown in FIG. 8A, the wire rods 4A and 4B in an inner side on the winding core 2 are fed by an amount of two wire rods to be wound. When two wire rods 4*a* and 4*b* move on the wire rods 4A and 4B in the lower layer, they are twisted to replace an arrangement of the wire rods. A detailed winding method of the wire rods 4*a* and 4*b* is the same as the winding method of the twist portion 6 in the multilayer coil 400.

(4) On the next plan face 2*b*, as shown in FIG. 8B, the wire rods 4A, 4B, 4*a* and 4*b* are wound at the end of the winding core 2 without the feeding.

(5) On the back face 2*c* as the next wire rod feeding face, as shown in FIG. 8C, when two wire rods 4A and 4B move on from the lower layer to the upper layer, they are twisted to replace an arrangement of the wire rods. The two wire rods 4*a* and 4*b* in the upper layer are fed in the direction opposite to the direction in the lower layer by an amount of two wire rods to be wound. A detailed winding method of the wire rods 4A and 4B is the same as the winding method of the twist portion 6 in the multilayer coil 400.

(6) On the next bottom face d, as shown in FIG. 8*d*, the wire rods 4A, 4B, 4*a* and 4*b* are guided and wound in the groove formed between the neighboring wire rods in the lower layer without the feeding thereof.

(7) On the next front face 2*a*, as shown in FIG. 8C, the wire rods 4A, 4B, 4*a* and 4*b* are wound by feeding them in the direction opposite to that of the wire rod in the lower layer. At this point, since the twist portion 6 of the wire rods 4*a* and 4*b* is positioned closer to the end of the winding core 2, the wire rods 4A and 4B do not interfere with the twist portion 6 and intersect only the wire rods in the lower layer to be wound. Accordingly, in each of the intersections of the lower and upper layers the wire rods are wound and overlapped in two layers, not wound or overlapped in three layers.

In the fourth and fifth preferred embodiments as described above, cases of the numbers of wire rods in one set of two wire rods and in two sets of two wire rods are explained, but the present invention is not limited thereto and can be applied to a case where the set number of wire rods is three sets or more, that is, six or more wire rods. For example, in a case of three sets of two wire rods, the wiring may be made by the feeding equal in amount to two wire rods on three faces out of the four faces of the wiring core, and in a case of four sets of two wire rods, the winding may be made by the feeding equal in amount to two wire rods on all the four faces. In this case, at the end of the wire rod feeding face, two wire rods moving on from the lower layer to the upper layer are twisted to replace an arrangement of the wire rods. As a result, the wire rods in the lower layer intersect the wire rods in the upper layer in two layers, not in three layers.

Further, in a case of winding five or more sets of two wire rods, a cross section of the winding core may be a five or more-angle shape. Therefore, consider a case where the number of wire rods is set as "n" sets ("n" is the integer number of 1 or more) of two wire rods and the "n" sets of two wire rods are wound in line around a winding core having a cross section of a "N"-angle shape ($N \geqq n$). In this case, on any "n" faces out of the "N" faces of the winding core, the winding is made by the feeding equal in amount to two wire rods. At the end of each of "n" faces, two wire rods moving on from the lower layer to the upper layer are twisted to replace an arrangement of the wire rods. By thus winding the "n" sets of two wire rods, the wire rods are prevented from bulging in the outer direction on the "n" pieces of the wire rod feeding faces, thereby providing a compact multilayer coil.

Sixth Preferred Embodiment

Figure 9A:
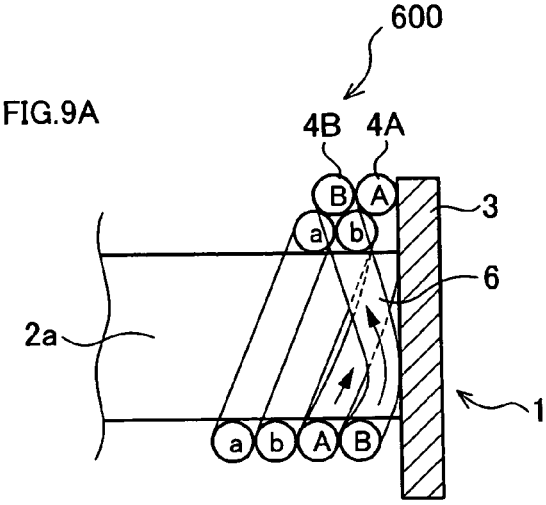
FIGS. 9A–9F are views, each showing a winding method at a winding core end of a multilayer coil in a sixth preferred embodiment of the present invention.
Figure 9D:
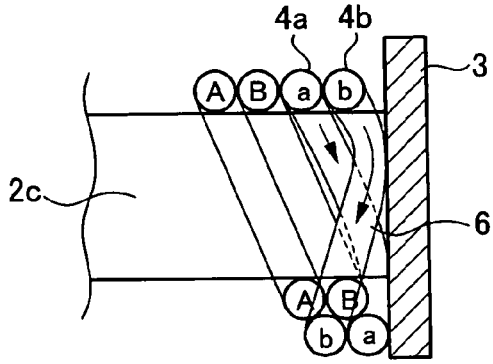
Figure 9B:
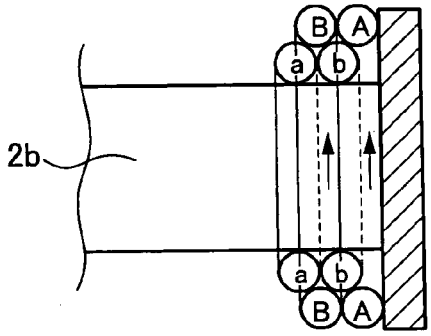
Figure 9E:
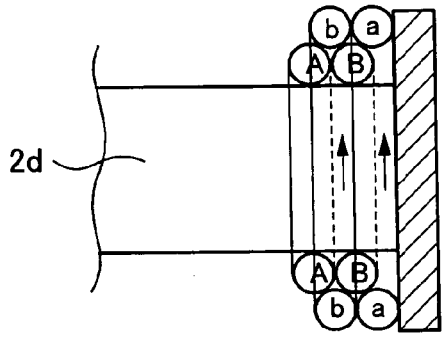
Figure 9C:
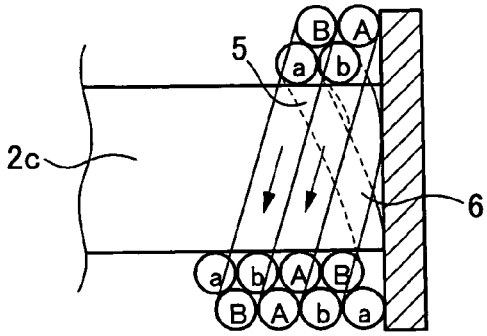
Figure 9F:
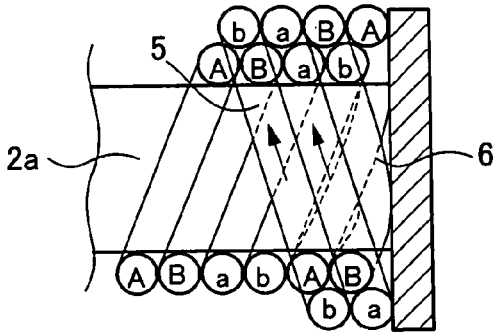

Next, a multilayer coil 600 as an alternative to the fifth preferred embodiment of the present invention will be explained with reference to FIGS. 9A–8F. FIGS. 9A and 9F show a winding method at an end of a winding core in the multilayer coil 600. FIGS. 9A and 9F are front views, FIG. 9B is a plan view, FIGS. 9C and 9D are rear views and FIG. 8E is a bottom view. It should be noted that for explanatory convenience, the rear views 9C and 9D show a state where the bobbin 1 is seen transparently from the front side. In addition, only wire rods related to the explanation are illustrated and the other wire rods are not illustrated.

The multilayer coil 600 differs from the multilayer coil 500 in a point that a face at start of winding one set of two wire rods 4A and 4B is different from a face at start of winding one set of two wire rods 4*a* and 4*b* in the multilayer coil 600, while the winding starts with the same face of the winding core in the multilayer coil 500.

The wire rods 4A and 4B begin to be wound on the front face 2*a* and at the same time the wire rods 4*a* and 4*b* begin to be wound on the back face 2*c* opposed to the front face 2*a*. FIGS. 9A and 9D, FIGS. 9B and 9E, and FIGS. 9C and 9F are opposed in time to each other. The wire rod feeding faces are two opposing faces as the front face 2*a* and the back face 2*c* and the feeding in amount is set as an amount of two wire rods. The feeding is not made on the other two faces as the plan face 2*b* and the bottom face 2*d*.

As seen in FIGS. 9A–9F, even a case where each of two sets of two wire rods (4A, 4B, 4*a* and 4*b*) begins to be wound on a different face can provide a multilayer coil having the same construction with the multilayer coil 500 where each set of the wire rods begins to be wound on the same face.

That is, in a case where "n" sets of two wire rods ("n" is the integer number of two or more) are wound in line on the winding core having a cross section of a "N"-angle shape, it is possible that each of "n" sets of two wire rods begin to be wound on the "n" different faces of the winding core.

As described above, the first—third preferred embodiments show that the feeding of the wire rod 4 on one face of the bobbin 1 is an amount of one wire rod, and the fourth-sixth preferred embodiments show that the feeding of the wire rod 4 on one face of the bobbin 1 is an amount of two wire rods.

Next, a multilayer coil in a case where the feeding of the wire rod 4 on one face of the bobbin 1 is an amount other than one or two wire rods will be explained.

Seventh Preferred Embodiment

Figure 10A:
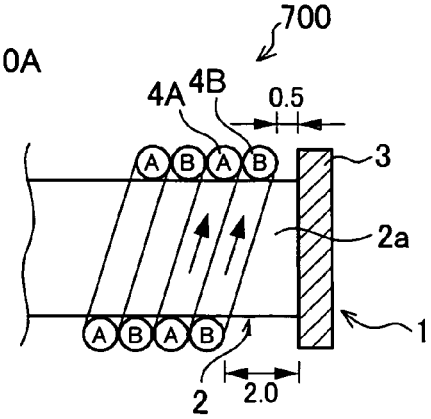
FIGS. 10A–10H are views, each showing a winding method at a winding core end of a multilayer coil in a seventh preferred embodiment of the present invention.
Figure 10E:
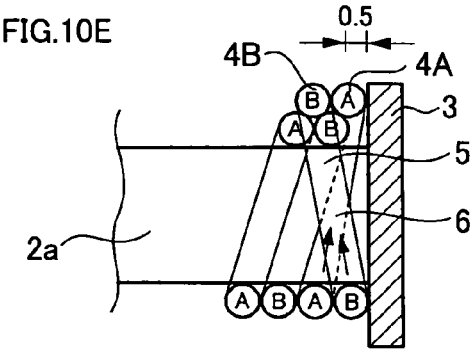
Figure 10B:
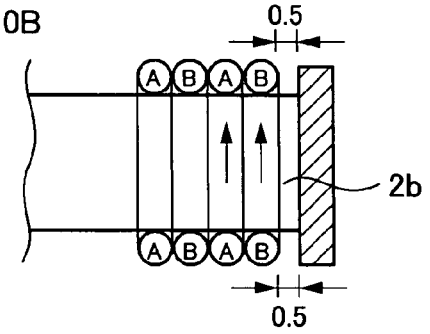
Figure 10F:
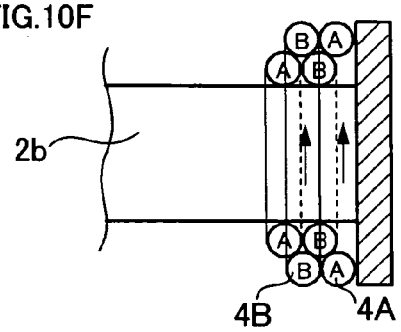
Figure 10C:
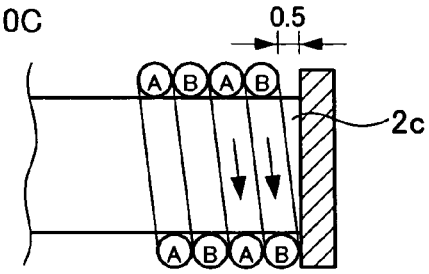
Figure 10G:
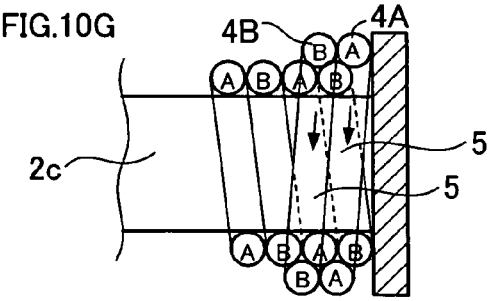
Figure 10D:
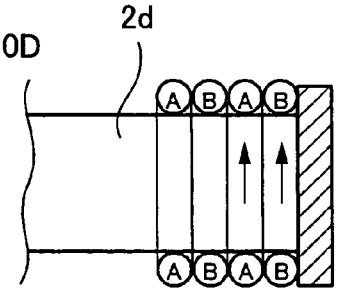
Figure 10H:
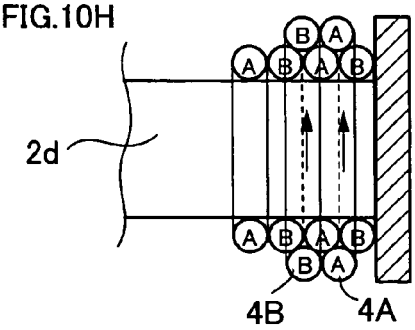

Next, a multilayer coil 700 in a seventh preferred embodiment of the present invention will be explained with reference to FIGS. 10A–10H. FIGS. 10A–10H show a winding method at an end of a winding core in the multilayer coil 700. FIGS. 10A and 10E are front views, FIGS. 10B and 10F are plan views, FIGS. 10C and 10G are rear views and FIGS. 10D and 10H are bottom views. It should be noted that for explanatory convenience, the rear views 10C and 10G show a state where the bobbin 1 is seen transparently from the front side. In addition, only wire rods related to the explanation are illustrated and the other wire rods are not illustrated.

The multilayer coil 700, the wire rods 4A and 4B diameters of which are nearly the same are wound in parallel and in line on the winding core 2 having a cross section of a square shape. Wire rod feeding faces are two opposing faces composed of a front face 2*a* and a back face 2*c*. On the front face 2*a*, the feeding is set as an amount equal to 1.5 wire rods and on the back face 2*c*, the feeding is set as an amount equal to 0.5 wire rods. On the other two faces as the plan face 2*b* and bottom face 2*d*, the feeding is not made. Thus in the multilayer coil 700, the feeding equal in amount to two wire rods is made during a period when the wire rods 4A and 4B are wound by one round around the winding core 2. In a case of winding wire rods in multiple layers around the winding core 2, the winding direction of the wire rods in the lower layer is opposite to the winding direction of the wire rods in the upper layer on the front face 2*a* and the back face 2*c*. In this way, the multilayer 700 includes an intersection portion 5 on each of the front face 2*a* and the back face 2*c* where the wire rods in the lower layer and the wire rod in the upper layer intersect.

The multilayer coil 700 includes a twist portion 6 at the end of the front face 2*a*. In the twist portion 6, two wire rods 4A and 4B, as shown in FIG. 10E, are twisted and an arrangement of the wire rods is replaced.

Next, a winding method of the multilayer coil 700 will be explained.

(1) Two wire rods 4A and 4B begin to be wound in parallel from the same face of the winding core 2 having a cross section of a square shape.

(2) As shown in FIGS. 10A–10D, the feeding equal in amount to 1.5 wire rods is produced on the front face 2*a*, the feeding equal in amount to 0.5 wire rods is produced on the back face 2*c*, and not on the plan face 2*b* or the bottom face 2*d*. Thus in the multilayer coil 700, the feeding equal in amount to a total two wire rods is made during a period when the wire rods 4A and 4B are wound by one round around the winding core 2.

(3) At the end of the front face 2*a*, as shown in FIG. 10C, the wire rods 4A and 4B are twisted and wound to replace an arrangement of the wire rods 4A and 4B. In more detail, the wire rod 4A in an inner side on the winding core 2 moves on a clearance formed between the wire rod in the lower layer and the collar 3, the clearance having a width equal in amount to 0.5 wire rods, to be wound in an upper layer. In addition, the wire rod 4B in an outer side on the winding core 2 is wound in the opposite direction to the winding direction of the wire rod in the lower layer and intersects with and on the wire rod 4A. Thereby, the wire rod 4B forms a twist portion 6 and also intersects the wire rod in the lower layer to be moved and wound on a groove between neighboring wire rods wound in the lower layer. In this way, there are produced at the end of the front face 2*a* the twist portion 6 generated by twisting the wire rods 4A and 4B and the intersection portion 5 generated by intersection of the wire rod 4B and the wire rod in the lower layer. In both of the twist portion 6 and the intersection portion 5, the wire rods are wound and overlapped in two layers, not in three layers.

(4) On the plan face 2*b*, as shown in FIG. 10F, the wire rods 4A and 4B are wound at the end of the winding core 2 without the feeding.

(5) On the next back face 2*c*, as shown in FIG. 10G, the wire rods 4A and 4B are fed by an amount of 0.5 wire rods in the opposite direction to the feeding direction of the wire rod in the lower layer to be wound. Thus on the back face 2*c*, the wire rods in the lower and upper layers intersect. However, at any of the intersections 5, the wire rods are wound and overlapped in two layers, not in three layers.

(6) On the next bottom face 2*d*, as shown in FIG. 10H, the wire rods 4A and 4B are guided and wound on the clearance between the neighboring wire rods in the lower layer without the feeding.

In the multilayer coil 700 in the seventh preferred embodiment as described above, the wire rod feeding faces are set as the front face 2*a* and the back face 2*c*, and the feeding of the wire rod is an amount of 1.5 wire rods on the front face 2*a* and an amount of 0.5 wire rods on the back face 2*c*. However, the present invention is not limited thereto, and the wire rod feeding face may be set as any face of the winding core 2. And also, if the wire rod is fed by a total amount of two wire rods during a period when the wire rod is wound by one round around the winding core 2, the feeding of the wire rod on the wire rod feeding face may be set as any amount. For example, the winding is possible by the feeding equal in amount to 0.5 wire rods on each of all the faces (four faces). In this case, at the end of one face out of the respective faces of the winding core 2, a twist portion 6 is formed, where two wire rods are twisted and an arrangement of the wire rods is replaced, thus preventing bulge of the wire rod in an outer diameter on the wire rod feeding face.

In the multilayer coil 700, a case where the number of wire rods is two is explained, but the present invention is not limited thereto and can be applied to a case where the number of wire rods is three or more. Therefore, consider a case where the number of wire rods is set as "n" pieces ("n" is the integer number of 2 or more) and the "n" pieces of wire rods are wound in line around a winding core having a cross section of a "N"-angle shape ($N \geqq n$). In this case, on any face out of the "N" faces, the winding is made by the feeding equal in total amount to "n" wire rods. At the end of at least one face out of the faces where the feeding is made, two wire rods out of "n" wire rods are twisted to replace an arrangement of the wire rods. By thus winding the "n" wire rods, the wire rod is prevented from bulging in the outer direction on the wire rod feeding face, thereby providing a compact multilayer coil.

As seen from the seventh preferred embodiment as described above, in a case of winding the "n" wire rods ("n" is the integer number of two or more) in line around the winding core having a cross section of a polygonal shape, if the winding is made by the feeding equal in total amount to "n" wire rods during a period when the wire rod is wound by one round around the winding core, the feeding of the wire rods on the wire rod feeding face is not limited in amount to the integer number of wire rods.

Next, a winding apparatus of a multilayer coil will be explained.

Eighth Preferred Embodiment

Figure 11:
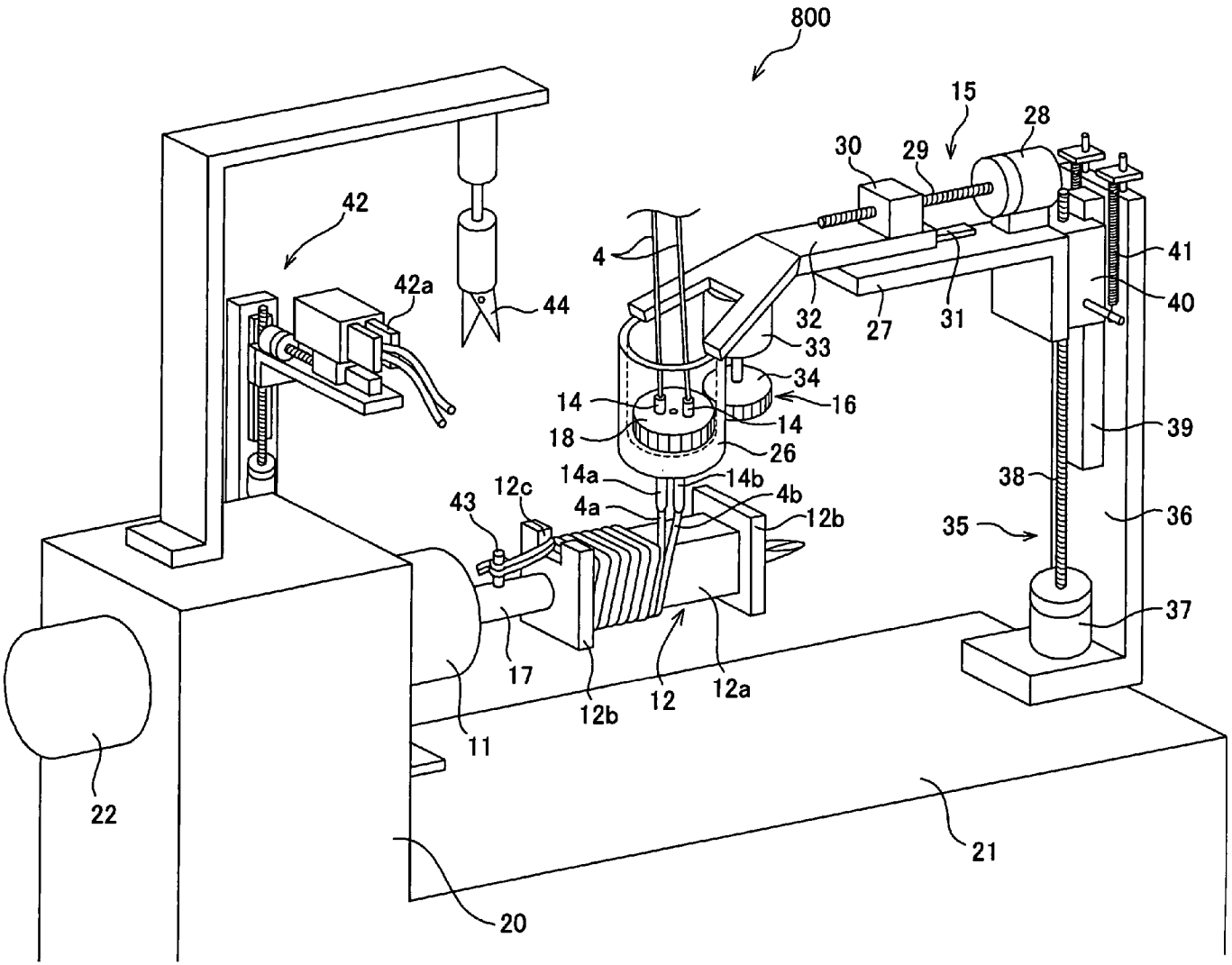
FIG. 11 is a perspective view showing a multilayer apparatus in an eighth preferred embodiment according to the present invention.

A winding apparatus 800 in an eighth preferred embodiment of the present invention will be explained with reference to FIG. 11. FIG. 11 is a perspective view showing the winding apparatus 800.

The winding apparatus 800 winds wire rods 4 around a bobbin 12 rotating with a spindle shaft 11 rotating around an axis. The winding apparatus 800 is equipped with a plurality of nozzles 14 leading the wire rods 4 from a wire rod source (not shown) to the bobbin 12, wire rod feeding mechanism 15 to move the nozzles 14 to an axial direction of a winding core 12*a* of the bobbin 12, and wire rod twist mechanism 16 to replace locations of the nozzles 14 and twist the wire rods 4.

The spindle shaft 11 is supported by a spindle support table 20 standing on abase table 21, and is controlled and rotated by a spindle motor 22 connected to one end of the spindle shaft 11.

The bobbin 12 is supported by a winding tool 17 fixed to the other end of the spindle shaft 11. The bobbin 12 is composed of the winding core 12*a* around which the wire rods 4 are wound, and collars 12*b* disposed co-axially with the winding core 12*a* at both sides of the winding core 12*a*. A notch 12*c* is disposed in one of the collars 12*b* to guide the wire rods 4 at start of winding the wire rods 4. The bobbin 12 is fixed such that an axial direction of the winding core 12*a* corresponds to an axial direction of the spindle shaft 11.

The nozzle 14 is cylindrical, and the nozzles 14 in number corresponding to at least the number of the wire rods are placed in the direction perpendicular to the spindle shaft 11 and supported by a nozzle support 18.

The plurality of the nozzles 14 penetrate and are fixed to the nozzle support 18 and are supported integrally therewith. The nozzle support 18 is received in a housing 26 to rotate around an axis and formed in a column shape, having teeth in an outer periphery.

The wire rod feeding mechanism 15 is provided with a wire rod feeding motor 28 disposed on a base plate 27, a ball screw 29 connected to an out put shaft of the wire rod feeding motor 28 and extending in an axial direction of the spindle shaft 11, an axial travel table 30 screwing with the ball screw 29 and traveling in the axial direction of the spindle shaft 11, a linear guide 31 disposed on the base plate 27 and extending in the axial direction of the spindle shaft 11, and a support plate 32 which supports the housing 26 and also is fixed to the axial travel table 30 to move along the linear guide 31. Hereby, an operation of the wire rod feeding mechanism 15 allows the nozzle support 18 received in the housing 26 to travel in the axial direction of the winding core 12*a*.

The wire rod twist mechanism 16 is provided with a nozzle location changing motor 33 connected to the support plate 32, and a rotating member 34 which is connected to an output shaft of the nozzle location changing motor 33 and teeth in an outer periphery of which are engaged with teeth in the outer periphery of the nozzle support 18. In this way, the nozzle support 18 and the rotating member 34 constitute a gear and act as nozzle support rotating mechanism. Accordingly, driving the nozzle location changing motor 33 causes rotation of the rotating member 34 and then the rotation is transmitted to the nozzle support 18, which is then rotated. Hereby, the nozzles 14 are rotated around the rotational axis of the nozzle support 18, so that the wire rods 4*a* and 4*b* reeled out from the nozzles 14*a* and 14*b* are twisted and intersect with each other.

The winding apparatus 800 is provided with axis-orthogonal travel mechanism 35 which travels the wire rod feeding mechanism 15 in the direction (upward and downward directions in FIG. 11) perpendicular to the spindle shaft 11. The axis-orthogonal travel mechanism 35 is provided with a support table 36 standing on the base table 21 and extending in the direction perpendicular to the spindle shaft 11, an upward and downward travel motor 37 located on the support table 36, a ball screw 38 connected to an output shaft of the upward and downward travel motor 37 and extending in the direction perpendicular to the spindle shaft 11, a linear guide 39 fixed to the support table 36 and extending in the direction perpendicular to the spindle shaft 11, and an axis-orthogonal travel table 40 screwing with the ball screw 38 to move along the linear guide 39. The axis-orthogonal travel table 40 is fixed to the base plate 27 of the wire rod feeding mechanism 15. Accordingly, the base plate 27 travels in the direction perpendicular to the spindle shaft 11 together with the axis-orthogonal travel table 40. The weight of the axis-orthogonal travel table 40 and the base plate 27 is supported by a spring 41 mounted to the support table 36.

Next, operations of the winding apparatus 800 will be explained. It should be noted that a case where the number of wire rods is two as shown in the figure is explained.

(1) The bobbin 12 is fixed to the winding tool 17 such that an axial direction of the bobbin 12 corresponds to an axial direction of the spindle shaft 11.

(2) Two nozzles 14*a* and 14*b* are fixed to and penetrate through the nozzle support 18 circularly around the rotational axis of the nozzle support 18.

(3) The wire rods 4*a* and 4*b* from the wire rod source (not shown) are reeled out respectively from tips of the nozzles 14*a* and 14*b* and are retained by a clamp 42*a* of a clamp apparatus 42.

(4) After the wire rods 4*a* and 4*b* are wound around an engagement pin 43 on the winding tool 17, the wire rod between the clamp 42 and the engagement pin 43 is cut by a cutter 44.

(5) Operations of the wire rod feeding mechanism 15 and the axis-orthogonal travel mechanism 35 cause travel of the nozzles 14*a* and 14*b* in the axial and orthogonal directions of the spindle shaft 11, thereby guiding the wire rods 4*a* and 4*b* through the notch 12*c* formed in the bobbin 12 to the winding core 12*a*.

(6) Rotating the spindle shaft 11 causes rotation of the bobbin 12, thereby winding the wire rods 4*a* and 4*b* around the winding core 12*a*.

(7) The feeding of the wire rods is made on a predetermined face during one rotation of the bobbin 12 by driving the wire rod feeding motor 28 of the wire rod feeding mechanism 15 and traveling the nozzle support 18 in the axial direction of the spindle shaft 11. For example, in a case of the multilayer coil in the first—third preferred embodiments, the feeding of the wire rods corresponds in amount to one wire rod in the axial direction of the spindle shaft 11. In a case of the multilayer coil in the fourth—sixth preferred embodiments, the feeding of the wire rods corresponds in amount to two wire rods in the axial direction of the spindle shaft 11.

(8) At the end of the winding core 12*a*, the nozzle location changing motor 33 of the wire rod twist mechanism 16 is driven to rotate the nozzle support 18 at 180 degrees through the rotating member 34, thereby replacing locations of two nozzles 14*a* and 14*b*. The two wire rods 4*a* and 4*b* are thus twisted and intersected, thereby replacing an arrangement of the wire rods.

(9) After the winding to the bobbin 12 is completed, operations of the wire rod feeding mechanism 15 and the axis-orthogonal travel mechanism 35 cause travel of the nozzles 14*a* and 14*b* in the axial and orthogonal directions of the spindle shaft 11, thereby putting the wire rods 4*a* and 4*b* through the notch 12*c* disposed in the bobbin 12. Thereafter, the clamp 42 is traveled toward the nozzles 14*a* and 14*b* by the clamp apparatus 42, the wire rods 4*a* and 4*b* reeled out from the tips of the nozzles 14*a* and 14*b* are retained by the clamp 42*a*, and the wire rod between the bobbin 12 and the clamp 42*a* is cut by the cutter 44.

Since the winding apparatus 800 as described above is provided with the wire rod twist mechanism 16, the two wire rods are twisted at the end of the winding core 12*a* and the arrangement can be replaced. Accordingly, a multilayer coil manufactured by the winding apparatus 800 prevents the wire rod from bulging in an outer direction on the wire rod feeding face, thereby providing a compact multilayer coil.

Ninth Preferred Embodiment

Figure 12:
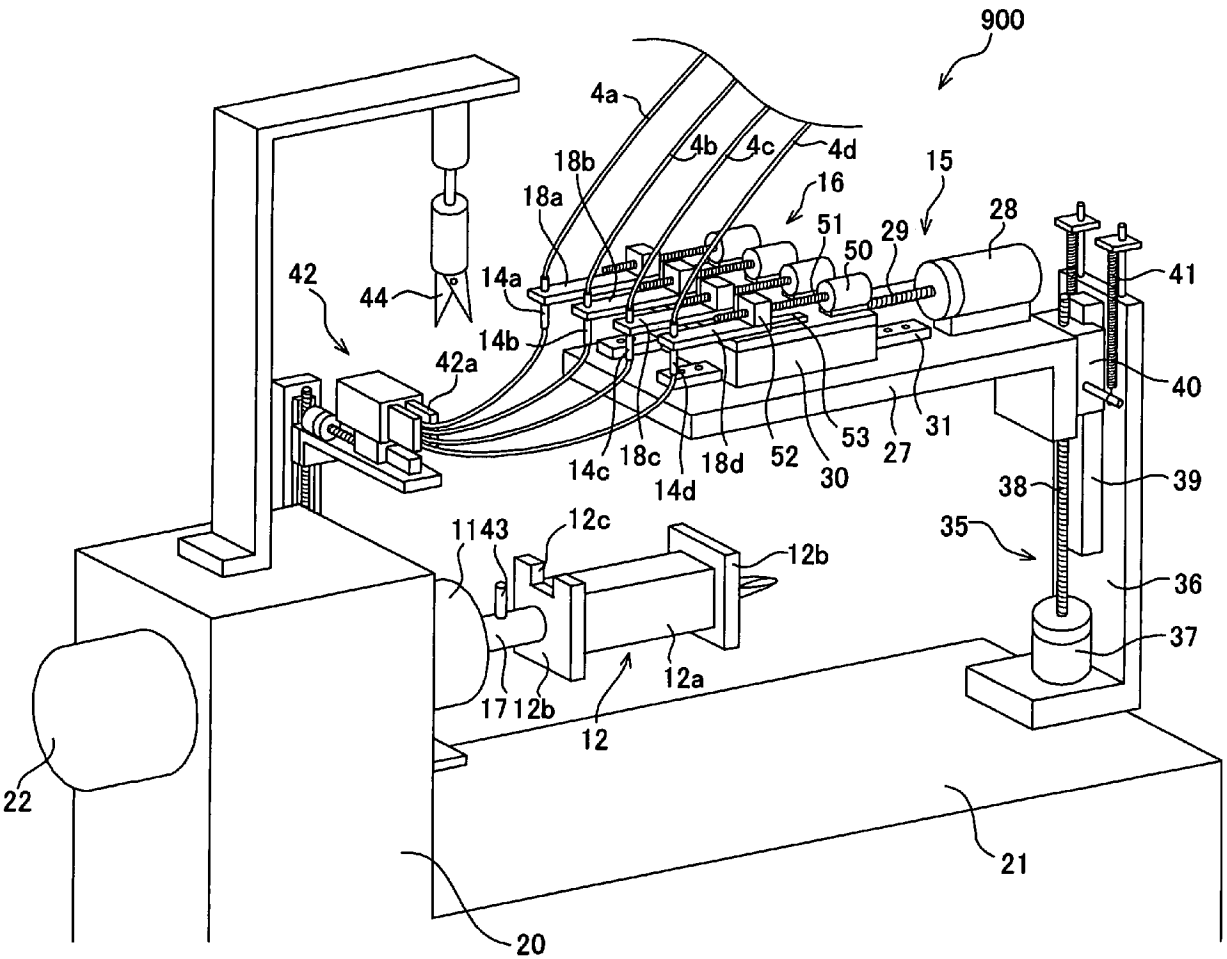
FIG. 12 is a perspective view showing a multilayer apparatus in a ninth preferred embodiment according to the present invention.
Figure 13:
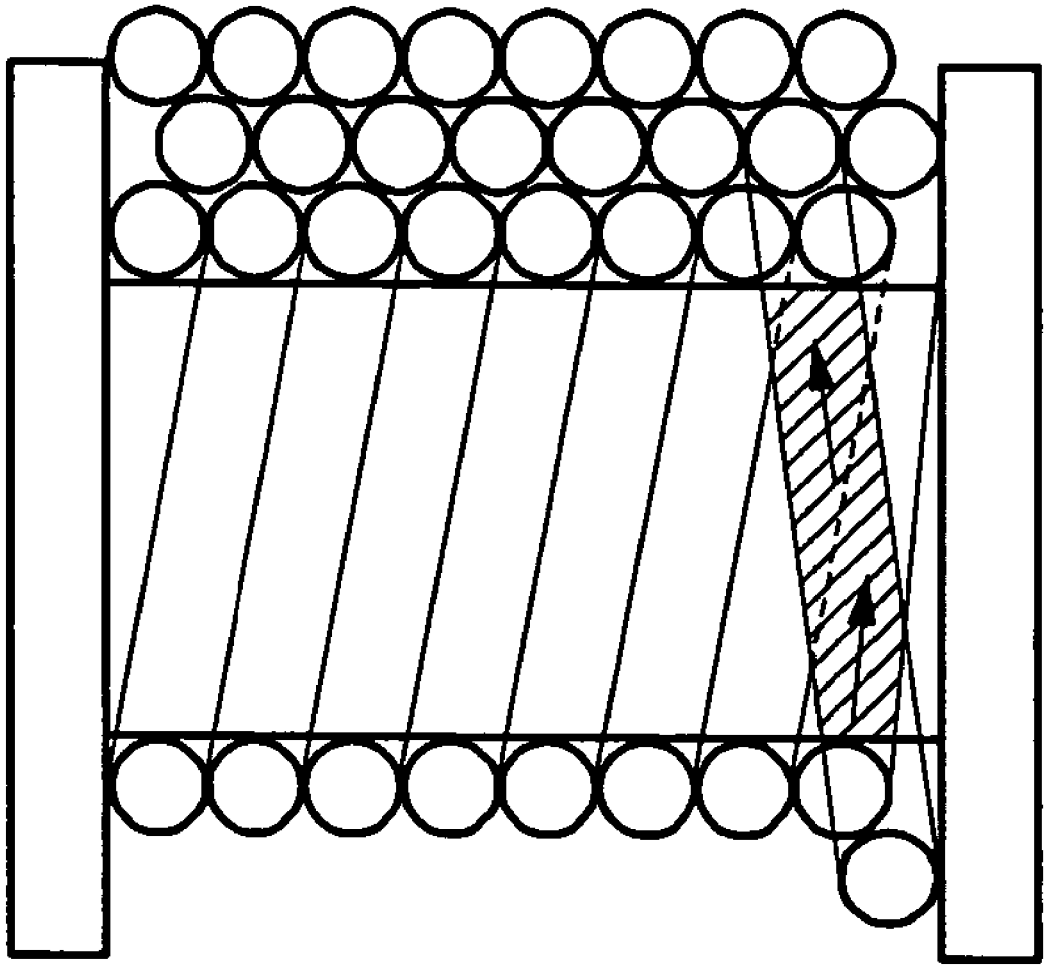
FIG. 13 is a view showing a conventional multilayer coil.
Figure 14A:
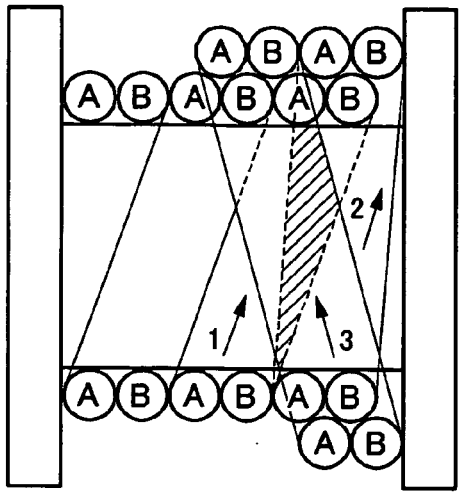
FIGS. 14A–14C are views, each showing a conventional multilayer coil.
Figure 14B:
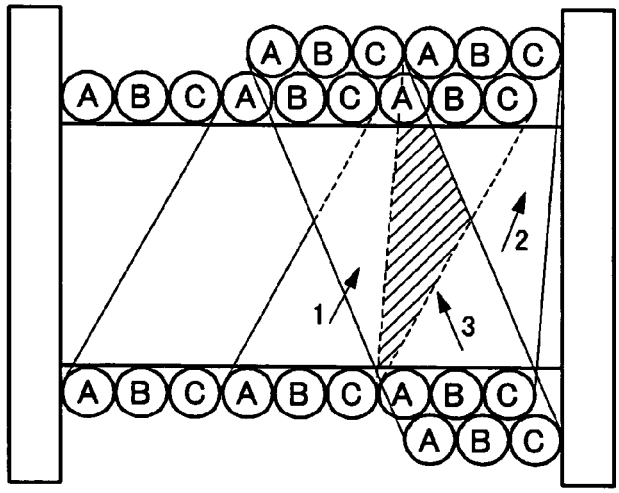
Figure 14C:
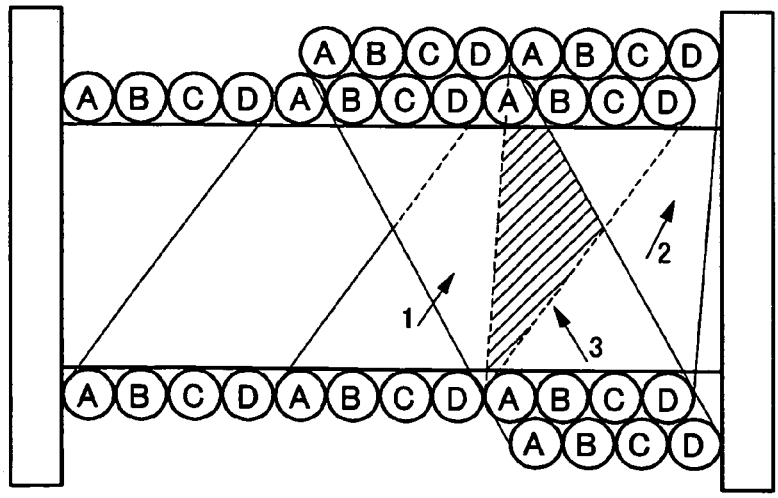

A winding apparatus 900 in a ninth preferred embodiment of the present invention will be explained with reference to FIG. 12. FIG. 12 is a perspective view showing the winding apparatus 900. Components identical to those in the above-mentioned winding apparatus 800 are referred to as the same numerals and the explanation thereof is omitted. The number of wire rods is exemplified as four (4*a*–4*d*) as shown in the figure.

The winding apparatus 900 differs from the winding apparatus 800 in a point that nozzle supports 18 support a plurality of nozzles 14 individually and the wire rod twist mechanism 16 travels the nozzle supports 18 in the axial direction of the winding core 12*a* individually. Hereinafter, differences in the winding apparatus 900 from the winding apparatus 800 will be mainly explained.

The nozzle supports 18*a*–18*d* are made of sheet materials and support the plurality of the nozzles 14*a*–14*d* individually.

The wire rod feeding mechanism 15 is provided with a wire rod feeding motor 28 disposed on a base plate 27, a ball screw 29 connected to an out put shaft of the wire rod feeding motor 28 and extending in an axial direction of the spindle shaft 11, a linear guide 31 disposed on the base plate 27 and extending in the axial direction of the spindle shaft 11, and an axial travel table 30 screwing with the ball screw 29 and traveling along the linear guide 31.

The wire rod twist mechanism 16 is provided with plural sets (four sets in the winding apparatus 900), the one set being composed of a nozzle location changing motor 50 disposed on an axial travel table 30, and a ball screw 51 connected to an output shaft of the nozzle location changing motor 50 and extending in the axial direction of the spindle shaft 11, a second axial travel table 52 screwing with the ball screw 51 and fixed to the nozzle support 18, and a linear guide 53 extending in the axial direction of the spindle shaft 11 on the axial travel table 30 to guide the nozzle support 18. Thereby, the wire rod twist mechanism 16 can travel the nozzle supports 18*a*–18*d* in the axial direction of the winding core 12*a* individually.

Next, operations of the winding apparatus 900 will be explained.

(1) The bobbin 12 is fixed to the winding tool 17 such that an axial direction of the bobbin 12 corresponds to an axial direction of the spindle shaft 11.

(2) Four nozzles 14*a*–14*d* are fixed to and penetrate through the nozzle supports 18*a*–18*d*. Driving the nozzle location changing motors 50 respectively corresponding to the nozzles 14*a*–14*d* allows displacement of the nozzles 14*a*–14*d* in an axial position of the winding core 12*a* by an amount of one wire rod (a state shown in FIG. 12).

The next steps (3)–(6) are the same as in the winding apparatus 800.

(7) The feeding of the wire rods is made on a predetermined face during one rotation of the bobbin 12 by driving the wire rod feeding motor 28 of the wire rod feeding mechanism 15 and traveling the axial travel table 30 in the axial direction of the winding core 12*a*.

(8) At the end of the winding core 12*a*, the nozzle location changing motors 50 corresponding to the nozzle supports 18 supporting the two wire rods to be twisted out of the nozzle supports 18*a*–18*d* are driven to replace a relative position of the nozzle supports 18 in the axial direction of the winding core 12*a* for supporting the two wire rods. The two wire rods are thus twisted and intersect, thereby replacing an arrangement of the wire rods.

(9) This step is the same as in the winding apparatus 800.

As described above, the winding apparatus 900 can travel the nozzle supports 18*a*–18*d* in the axial direction of the winding core 12*a* individually, and therefore, is effective in a case where a large number of wire rods are wound at the same time.

This application claims priority to Japanese Patent Application No. 2005-59134 and No. 2005-251242. The entire disclosure of Japanese Patent Application No. 2005-59134 and No. 2005-251242 is hereby incorporated herein by reference.

While only selected preferred embodiments have been chosen to illustrate the present invention, it will be apparent to those skilled in the art from this disclosure that various changes and modifications can be made herein without departing from the scope of the invention as defined in the appended claims. Furthermore, the foregoing description of the preferred embodiments according to the present invention is provided for illustration only, and not for the purpose of limiting the invention as defined by the appended claims and their equivalents.

What is claimed is:

1. A multilayer coil which winds "n" wire rods ("n" is an integer number of two or more) in line around a winding core having a cross section of a polygonal shape, comprising:

an intersection portion which is formed on "n" faces of the winding core and in which the wire rods in a lower layer and an upper layer intersect by feeding the wire rods by an amount of one wire rod; and a twist portion which is formed on "n−1" faces out of the "n" faces, in which two wire rods are twisted to replace an arrangement of the wire rods.

2. The multilayer coil according to claim 1, wherein:

the two wire rods to be twisted include:

a wire rod moving on from the lower layer to the upper layer; and a wire rod a winding direction of which is opposite to a winding direction of the wire rod in the lower layer.

3. A multilayer coil which winds "n" sets of two wire rods ("n" is an integer number of one or more) in line around a winding core having a cross section of a polygonal shape, comprising:

an intersection portion which is formed on "n" faces of the winding core and in which the wire rods in a lower layer and an upper layer intersect by feeding the wire rods by an amount of two wire rods; and a twist portion which is formed on the "n" faces and in which two wire rods are twisted to replace an arrangement of the wire rods.

4. The multilayer coil according to claim 3, wherein:

the two wire rods to be twisted include wire rods moving on from the lower layer to the upper layer.

5. The multilayer coil according to claim 3, wherein:

in a case where the "n" is an integer number of two or more, "n" sets of the two wire rods each begin to be wound from a different face of the winding core.

6. A multilayer coil which winds "n" wire rods ("n" is an integer number of two or more) in line around a winding core having a cross section of a polygonal shape, comprising:

an intersection portion which is formed on faces where feeding of the winding core is made and in which the wire rods in a lower layer and an upper layer intersect by feeding the wire rods by an amount of "n" wire rods during a period when the wire rods are wound by one round around the winding core; and a twist portion in which two wire rods out of the "n" wire rods are twisted to replace an arrangement of the wire rods at an end of at least one face out of the faces where the feeding of the winding core is made.

7. A winding method of a multilayer coil which winds "n" wire rods ("n" is an integer number of two or more) in line around a winding core having a cross section of a polygonal shape, comprising:

feeding the wire rod by an amount of one wire rod on "n" faces of the winding core; and replacing an arrangement of the wire rods on "n−1" faces out of the "n" faces by twisting two wire rods thereon as the wire rod moving on from a lower layer to an upper layer and the wire rod a winding direction of which is opposite to a winding direction of the wire rod in the lower layer.

8. A winding method of a multilayer coil which winds "n" sets of two wire rods ("n" is an integer number of one or more) in line around a winding core having a cross section of a polygonal shape, comprising:

feeding the wire rod by an amount of two wire rods on "n" faces of the winding core; and replacing an arrangement of the wire rods by twisting two wire rods moving on from a lower layer to an upper layer on the "n" faces.

9. The winding method of the multilayer coil according to claim 8, wherein:

in a case where the "n" is an integer number of two or more, the "n" sets of the two wire rods each begin to be wound from a different face of the winding core.

10. A winding method of a multilayer coil which winds "n" wire rods ("n" is an integer number of two or more) in line around a winding core having a cross section of a polygonal shape, comprising:

feeding the wire rod by an amount of "n" wire rods during a period when the wire rods is wound by one round around the wire core; and replacing an arrangement of the wire rods by twisting two wire rods out of the "n" wire rods at an end of at least one face out of the faces where the feeding of the winding core is made.

11. A winding apparatus of a multilayer coil, comprising:

a spindle shaft rotating around an axis together with a winding core on which wire rods are wound;

a plurality of nozzles leading the wire rods to the winding core;

wire rod feeding mechanism which travels the nozzles in an axial direction of the winding core; and wire rod twist mechanism which twists the wire rods by replacing locations of the nozzles.

12. The winding apparatus of the multilayer coil according to claim 11, wherein:

the plurality of the nozzles are supported integrally with and by a nozzle support; and the wire rod twist mechanism includes nozzle support rotating mechanism which rotates the nozzle support.

13. The winding apparatus of the multilayer coil according to claim 11, wherein:

the plurality of the nozzles each are supported by the nozzle support individually; and the wire rod twist mechanism travels the nozzle support in the axial direction of the winding core individually.

* * * * *